US009105236B2

(12) United States Patent
Shim et al.

(10) Patent No.: US 9,105,236 B2
(45) Date of Patent: Aug. 11, 2015

(54) LIGHT EMITTING DISPLAY DEVICE

(71) Applicant: LG Display Co., Ltd., Seoul (KR)

(72) Inventors: Jong-Sik Shim, Seoul (KR); Woo-Jin Nam, Goyang-si (KR); Min-Kyu Chang, Seoul (KR)

(73) Assignee: LG Display Co., Ltd., Seoul (KR)

( * ) Notice: Subject to any disclaimer, the term of this patent is extended or adjusted under 35 U.S.C. 154(b) by 145 days.

(21) Appl. No.: 13/627,925

(22) Filed: Sep. 26, 2012

(65) Prior Publication Data

US 2013/0093800 A1 Apr. 18, 2013

(30) Foreign Application Priority Data

Oct. 14, 2011 (KR) ..... 10-2011-0105266

(51) Int. Cl.

| | |
|---|---|
| ***G09G 5/10*** | (2006.01) |
| ***G09G 3/30*** | (2006.01) |
| ***G09G 3/32*** | (2006.01) |

(52) U.S. Cl.

CPC ..... *G09G 3/3233* (2013.01); *G09G 2300/0852* (2013.01); *G09G 2300/0861* (2013.01); *G09G 2310/0254* (2013.01); *G09G 2320/045* (2013.01)

(58) Field of Classification Search

USPC ..... 345/76–83, 204, 690; 315/169.3

See application file for complete search history.

(56) References Cited

U.S. PATENT DOCUMENTS

| | | | | |
|---|---|---|---|---|
| 2007/0030217 | A1 | 2/2007 | Peng | |
| 2010/0123700 | A1 | 5/2010 | Kim et al. | |
| 2010/0127956 | A1 | 5/2010 | Kang et al. | |
| 2011/0134166 | A1 * | 6/2011 | Shirasaki et al. | 345/690 |
| 2011/0164016 | A1 | 7/2011 | Kang et al. | |

FOREIGN PATENT DOCUMENTS

| | | | |
|---|---|---|---|
| CN | 101866614 | A | 10/2010 |
| CN | 101908316 | A | 12/2010 |
| EP | 2 242 039 | A1 | 10/2010 |
| JP | 2005-164892 | A | 6/2005 |
| JP | 2006-227239 | A | 8/2006 |
| WO | WO 2007/138729 | A1 | 12/2007 |

OTHER PUBLICATIONS

State Intellectual Property Office of the People's Republic of China, Second Office Action, Chinese Patent Application No. 201210382266.8, Feb. 2, 2015, sixteen pages.

European Patent Office, Search Report and Opinion, European Patent Application No. 12188089.2, Mar. 31, 2015, fifteen pages.

* cited by examiner

*Primary Examiner* — Charles V Hicks
*Assistant Examiner* — Jeffrey S Steinberg
(74) *Attorney, Agent, or Firm* — Fenwick & West LLP

(57) ABSTRACT

Disclosed herein is a light emitting display device capable of minimizing a difference in current driving capability between driving switching elements so as to improve image quality of the display device.

18 Claims, 23 Drawing Sheets

LIGHT EMITTING DISPLAY DEVICE

This application claims the benefit of Korean Patent Application No. 10-2011-0105266 filed on Oct. 14, 2011 which is hereby incorporated by reference as if fully set forth herein.

BACKGROUND OF THE INVENTION

1. Field of the Invention

The present invention relates to regulating a light emitting display device, and more particularly, to minimizing a difference in current driving capability of driving switching elements of the light emitting display device.

2. Discussion of the Related Art

Light emitting display devices include many pixels. The pixels of the light emitting display device include driving switching elements which provide driving currents to light emitting elements of the pixels. The current driving capabilities of the driving switching elements may be influenced by threshold voltages thereof. Specifically, two driving switching elements receiving the same gate voltage corresponding to the same image data to be displayed may generate different driving currents due to differences in their threshold voltages.

The differences in threshold voltages among the switching devices may impact image quality of the display device.

SUMMARY OF THE INVENTION

Accordingly, methods and apparatuses for compensating for a difference in current driving capability between the driving switching elements of the pixels of the light emitting display device are described herein.

In one aspect, a light emitting display device is capable of minimizing a difference in current driving capability between driving switching elements of pixels of the display device so as to improve image quality. The light emitting display device includes a plurality of pixels, and each pixel includes a light emitting element and a current driving element configured to provide driving current through the light emitting element when turned on. The current driving element includes a first terminal, a second terminal, and a third terminal. The first terminal is configured to receive a data signal voltage, and the current driving element is turned on to provide the driving current if a first voltage difference between the first terminal and the second terminal exceeds a threshold voltage. The magnitude of the driving current is dependent upon a second difference between the first voltage difference and the threshold voltage. Prior to the current driving element providing the driving current through the light emitting element, a voltage at the second terminal is set to be a sum of the threshold voltage and at least a predetermined constant value to compensate for the difference in the current driving capability across the driving switching elements of the pixels in the display device. As a result, the light emitting elements of the display may be driven more uniformly in response to substantially same data signals.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a light emitting display device includes a plurality of pixels for displaying an image; each pixel includes a data switching element controlled according to a scan signal from a scan line and coupled between a data line and a first node, a light emission control switching element controlled according to a light emission control signal from a light emission control line and coupled between the first node and a second node, a driving switching element controlled according to the voltage of the second node and coupled between a first driving power supply line for transmitting a first driving voltage and a third node, a sensing switching element controlled according to a sense signal from a sense line and coupled between a first capacitor and the second node, an initialization switching element controlled according to an initialization signal from an initialization line and coupled between the third node and an initialization power supply line for transmitting an initialization voltage, a reference switching element controlled according to the initialization signal from the initialization line and coupled between the second node and a reference power supply line for transmitting a reference voltage, a second capacitor coupled between the first node and the second node, a third capacitor coupled between the first node and the third node, and a light emitting diode having an anode electrode coupled to the third node and a cathode electrode coupled to a second driving power supply line for transmitting a second driving voltage; the first capacitor is coupled between the sensing switching element and the first driving power supply line; wherein the scan signal, the initialization signal, the light emission control signal and the sense signal are changed to an active state or an inactive state based on an initialization period, a threshold voltage detection period, a data writing period and a light emission period, all of which are sequentially generated; during the initialization period, the initialization signal, the sense signal and the light emission control signal are maintained in the active state and the scan signal is maintained in the inactive state; during the threshold voltage detection period, the sense signal is maintained in the active state and the initialization signal, the scan signal and the light emission control signal are maintained in the inactive state; during the data writing period, the scan signal and the sense signal are maintained in the active state and the initialization signal and the light emission control signal are maintained in the inactive state; during the data writing period, a data signal is supplied to the data line; and during the light emission period, the light emission control signal is sequentially in the active state and the inactive state or is maintained in the active state and the scan signal, the initialization signal and the sense signal are maintained in the inactive state.

The pulse width of the scan signal in the active state may be equal to the pulse width of the initialization signal in the active state, a p-th (p being a natural number) pixel and a (p+x)-th (x being a natural number) pixel may be located at different pixel rows, the phases of a scan signal supplied to the p-th pixel and a scan signal supplied to the (p+x)-th pixel may be different from each other, the phases of the scan signal supplied to the p-th pixel and an initialization signal supplied to the (p+x)-th pixel may be identical, and a scan line coupled to a data switching element of the p-th pixel and a light emission control line coupled to a light emission control switching element of the (p+x)-th pixel may be coupled to each other.

In another aspect of the present invention, a light emitting display device includes a plurality of pixels for displaying an image; each pixel includes a data switching element controlled according to a scan signal from a scan line and coupled between a data line and a first node, a light emission control switching element controlled according to a light emission control signal from a light emission control line and coupled between the first node and a second node, a driving switching element controlled according to the voltage of the second node and coupled between a first driving power supply line for transmitting a first driving voltage and a third node, a sensing switching element controlled according to a sense signal from a sense line and coupled between a first capacitor and the second node, an initialization switching element controlled according to an initialization signal from an initialization line and coupled between the third node and an initialization power supply line for transmitting an initialization voltage, a first reference switching element controlled according to the initialization signal from the initialization line and coupled between the first node and a reference power supply line for transmitting a reference voltage, a second reference switching element controlled according to the initialization signal from the initialization line and coupled between the second node and the reference power supply line, a second capacitor coupled between the first node and the second node, a third capacitor coupled between the first node and the third node, and a light emitting diode having an anode electrode coupled to the third node and a cathode electrode coupled to a second driving power supply line for transmitting a second driving voltage; the first capacitor is coupled between the sensing switching element and the first driving power supply line; the scan signal, the initialization signal, the light emission control signal and the sense signal are changed to an active state or an inactive state based on an initialization period, a threshold voltage detection period, a data writing period and a light emission period, all of which are sequentially generated; during the initialization period, the initialization signal and the sense signal are maintained in the active state and the scan signal and the light emission control signal are maintained in the inactive state; during the threshold voltage detection period, the sense signal is maintained in the active state and the initialization signal, the scan signal and the light emission control signal are maintained in the inactive state; during the data writing period, the scan signal and the sense signal are maintained in the active state and the initialization signal and the light emission control signal are maintained in the inactive state; during the data writing period, a data signal is supplied to the data line; and, during the light emission period, the light emission control signal is sequentially in the active state and the inactive state or is maintained in the active state and the scan signal, the initialization signal and the sense signal are maintained in the inactive state.

In another aspect of the present invention, a light emitting display device includes a plurality of pixels for displaying an image; each pixel includes a data switching element controlled according to a scan signal from a scan line and coupled between a data line and a first node, a light emission control switching element controlled according to a light emission control signal from a light emission control line and coupled between the first node and a second node, a driving switching element controlled according to the voltage of the second node and coupled between a cathode electrode of a light emitting element and a third node, a sensing switching element controlled according to a sense signal from a sense line and coupled between a first capacitor and the second node, an initialization switching element controlled according to an initialization signal from an initialization line and coupled between the third node and an initialization power supply line for transmitting an initialization voltage, a reference switching element controlled according to the initialization signal from the initialization line and coupled between the second node and a reference power supply line for transmitting a reference voltage, a second capacitor coupled between the first node and the second node, a third capacitor coupled between the first node and the third node, and a light emitting diode having an anode electrode coupled to the third node and a cathode electrode coupled to a second driving power supply line for transmitting a second driving voltage; the anode electrode of the light emitting diode is coupled to the first driving power supply line; the first capacitor is coupled between the sensing switching element and the first driving power supply line; the scan signal, the initialization signal, the light emission control signal and the sense signal are changed to an active state or an inactive state based on an initialization period, a threshold voltage detection period, a data writing period and a light emission period, all of which are sequentially generated; during the initialization period, the initialization signal, the sense signal and the light emission control signal are maintained in the active state and the scan signal is maintained in the inactive state; during the threshold voltage detection period, the sense signal is maintained in the active state and the initialization signal, the scan signal and the light emission control signal are maintained in the inactive state; during the data writing period, the scan signal and the sense signal are maintained in the active state and the initialization signal and the light emission control signal are maintained in the inactive state; during the data writing period, a data signal is supplied to the data line; and, during the light emission period, the light emission control signal is sequentially in the active state and the inactive state or is maintained in the active state and the scan signal, the initialization signal and the sense signal are maintained in the inactive state.

In another aspect of the present invention, a light emitting display device includes a plurality of pixels for displaying an image; each pixel includes a data switching element controlled according to a scan signal from a scan line and coupled between a data line and a first node, a light emission control switching element controlled according to a light emission control signal from a light emission control line and coupled between the first node and a second node, a driving switching element controlled according to the voltage of the second node and coupled between a cathode electrode of a light emitting diode and a third node, a sensing switching element controlled according to a sense signal from a sense line and coupled between a first capacitor and the second node, an initialization switching element controlled according to an initialization signal from an initialization line and coupled between the third node and an initialization power supply line for transmitting an initialization voltage, a first reference switching element controlled according to the initialization signal from the initialization line and coupled between the first node and a reference power supply line for transmitting a reference voltage, a second reference switching element controlled according to the initialization signal from the initialization line and coupled between the second node and the reference power supply line, a second capacitor coupled between the first node and the second node, a third capacitor coupled between the first node and the third node, and an anode electrode of the light emitting diode is coupled to a first driving power supply line for transmitting a first driving voltage; the first capacitor is coupled between the sensing switching element and the first driving power supply line; the scan signal, the initialization signal, the light emission control signal and the sense signal are changed to an active state or an inactive state based on an initialization period, a threshold voltage detection period, a data writing period and a light emission period, all of which are sequentially generated; during the initialization period, the initialization signal and the sense signal are maintained in the active state and the scan signal and the light emission control signal are maintained in the inactive state; during the threshold voltage detection period, the sense signal is maintained in the active state and the initialization signal, the scan signal and the light emission control signal are maintained in the inactive state; during the data writing period, the scan signal and the sense signal are maintained in the active state and the initialization signal and the light emission control signal are maintained in the inactive state; during the data writing period, a data signal is supplied to the data line; and, during the light emission period, the light emission control signal is sequentially in the active state and the inactive state or is maintained in the active state and the scan signal, the initialization signal and the sense signal are maintained in the inactive state.

The first capacitor may be a parasitic capacitor between a gate electrode and a drain electrode of the driving switching element.

The initialization voltage may be less than the reference voltage, the reference voltage may be less than the second driving voltage, and the second driving voltage may be less than the first driving voltage.

The data switching element, the light emission switching element, the driving switching element, the sensing switching element, the initialization switching element and the reference switching element may all be n type transistors or p type transistors.

The data switching element, the light emission switching element, the driving switching element, the sensing switching element, the initialization switching element, the first reference switching element and the second reference switching element may all be n type transistors or p type transistors.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
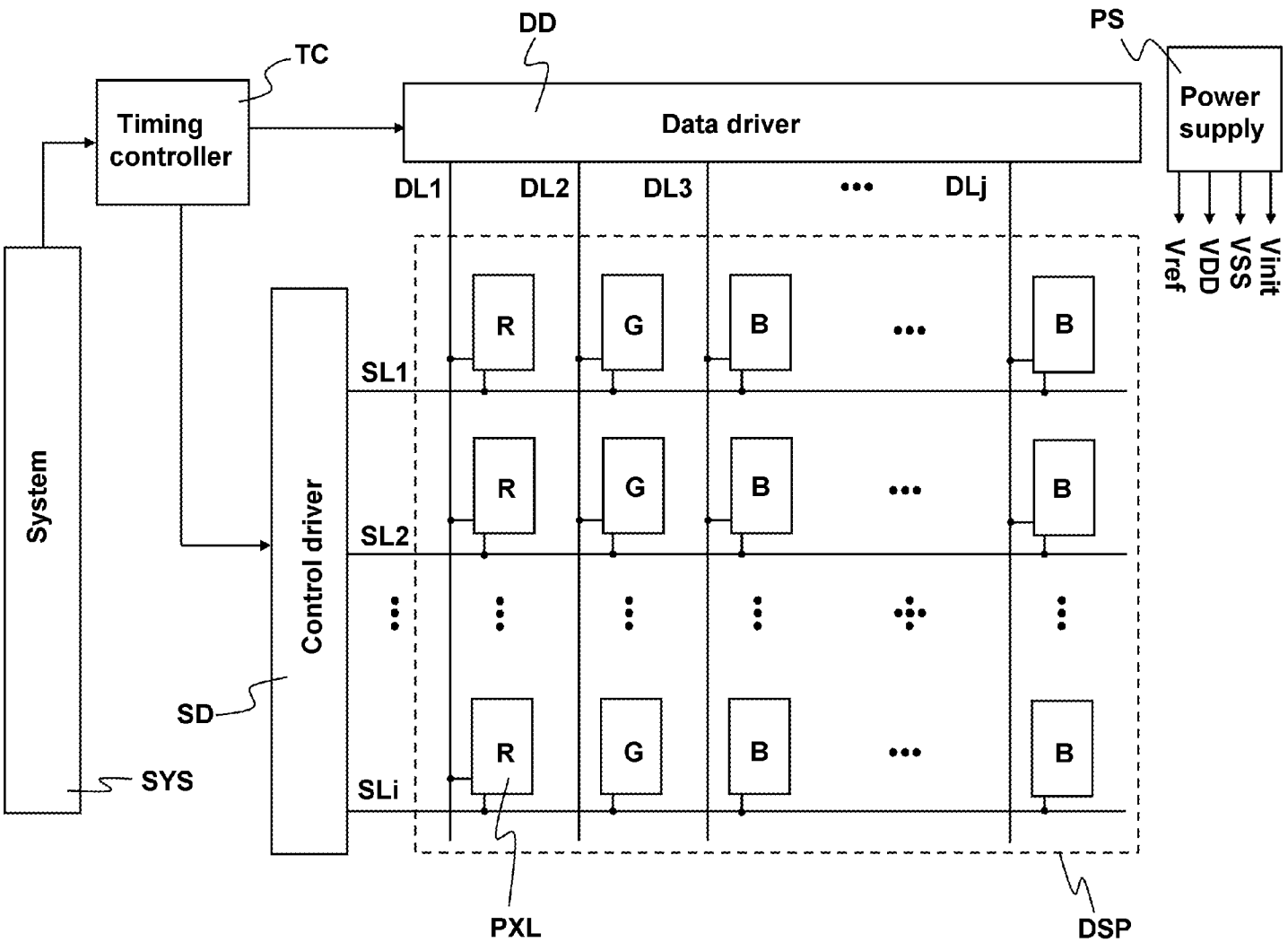
FIG. 1 is a diagram showing a light emitting display device according to one embodiment.

FIG. 1 is a diagram showing a light emitting display device according to one embodiment.

As shown, the light emitting display device may include, among other components, a display unit DSP, a system SYS, a control driver CD, a data driver DD, a timing controller TC and a power supply PS.

The display unit DSP includes a plurality of pixels PXL, a plurality of scan lines SL1 to SLi for transmitting a plurality of scan signals for sequentially driving the pixels PXL in horizontal line units, and a plurality of data lines DL1 to DLj and power supply lines. Although not shown, the display unit DSP may further include a plurality of initialization lines, light emission control lines and sense lines. The number of scan lines, the number of initialization lines, the number of light emission control lines and the number of sense lines may be the same.

The pixels PXL are arranged in the display unit DSP in a matrix. These pixels PXL are divided into red pixels R for displaying red, green pixels G for displaying green and blue pixels B for displaying blue. The order, RGB, of pixels PXL may differ from that illustrated herein.

The system SYS outputs signals such as a vertical sync signal, a horizontal sync signal, a clock signal and image data which may be received by one or more components, such as the timing controller TC. In one embodiment, the system SYS includes a low voltage differential signaling (LVDS) transmitter of a graphic controller and an interface circuit for outputting the various signals The timing controller TC receives the vertical/horizontal sync signal and the clock signal output from the system SYS. The timing controller TC also receives image data, which may be sequentially output from the system SYS for display. In turn, the timing controller TC generates a data control signal, a scan control signal and a light emission control signal using the vertical sync signal, the horizontal sync signal and the clock signal input thereto and supplies the generated signals to the data driver DD and the control driver CD.

The data driver DD samples the image data according to the data control signal from the timing controller TC, latches the sampled image data corresponding to one horizontal line at each horizontal time (1 H, 2 H, . . . ), and supplies the latched image data to the data lines DL1 to DLj. That is, the data driver DD converts the image data from the timing controller TC into analog pixel signals (data signals) using a gamma voltage received from the power supply PS and supplies the analog pixel signals to the data lines DL1 to DLj.

The control driver CD outputs scan pulses, initialization signals, light emission control signals and sense signals according to a control signal from the timing controller TC. For example, the control driver may sequentially output i scan signals from a first scan signal to an i-th scan signals at each frame. Also, the control driver CD may sequentially output i initialization signals from a first initialization signal to an i-th initialization signals at each frame. Also, the control driver CD may sequentially output i light emission control signals from a first light emission control signal to an i-th light emission control signal at each frame. Also, the control driver CD may sequentially output i sense signals from a first sense signal to an i-th sense signal at each frame.

The power supply PS may generate one or more of the voltages used by the components described herein. For example, the power supply PC may generate voltages such as a gamma voltage, a first driving voltage VDD, a second driving voltage VSS, a reference voltage Vref and an initialization voltage Vinit for driving the pixel PXL. The voltages themselves may differ, for example, the initialization voltage Vinit may be less than the reference voltage Vref, the reference voltage Vref may be less than the second driving voltage VSS, and the second driving voltage VSS may be less than the first driving voltage VDD. In one example mode of operation using the example components detailed herein, the first driving voltage VDD may be a constant voltage of about 10 [V] or more, the second driving voltage VSS may be a constant voltage of 0 [V], the reference voltage Vref may be a constant voltage having a level of about −2 [V] to 0 [V], and the initialization voltage Vinit may be a constant voltage having a level of −7 [V] to −6 [V]. The first driving voltage VDD is determined in consideration of the threshold voltage Vth of a light emitting element of the display, such as diode OLEDs, and thus may be changed according to the threshold voltage of the light emitting diode OLED used for a circuit.

First Embodiment

Figure 2:
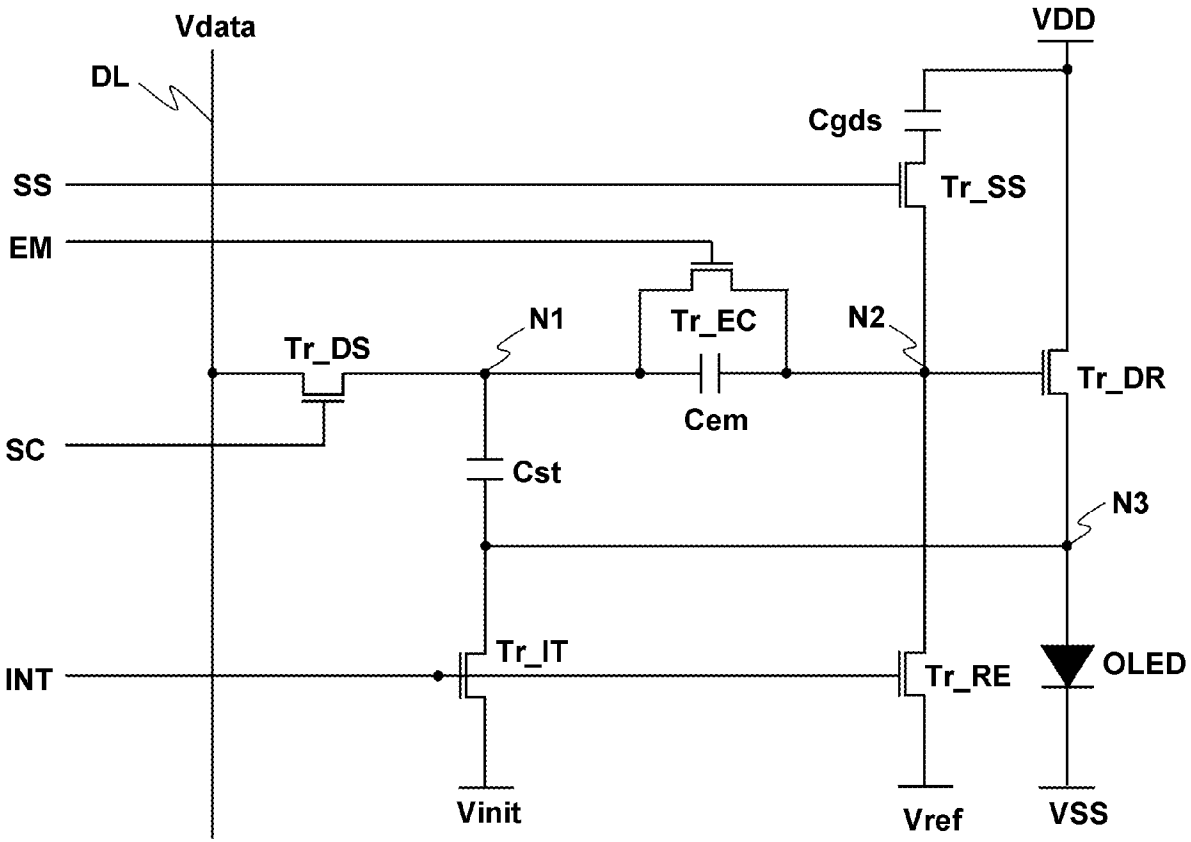
FIG. 2 is a diagram showing a circuit configuration of a pixel according to a first embodiment.

FIG. 2 is a diagram showing a circuit configuration of a pixel according to a first embodiment. FIG. 2 shows the circuit configuration of any one pixel PXL.

The illustrated pixel PXL includes a data switching element Tr_DS, a light emission control switching element Tr_EC, a driving switching element Tr_DR, a sensing switching element Tr_SS, an initialization switching element TR_IT, a reference switching element Tr_RE, a first capacitor Cgds, a second capacitor Cem, a third capacitor Cst and a light emitting diode OLED, as shown in FIG. 2. In one embodiment, the data switching element Tr_DS, the light emission control switching element Tr_EC, the driving switching element Tr_DR, the sensing switching element Tr_SS, the initialization switching element TR_IT and the reference switching element Tr_RE are n-type transistors. In other embodiments, the pixel PXL may include all p-type transistors or a combination of p- and n-type transistors.

The data switching element Tr_DS is controlled according to a scan signal SC from a scan line and is coupled between a data line DL and a first node N1.

The light emission control switching element Tr_EC is controlled according to a light emission control signal EM from a light emission control line and is coupled between the first node N1 and a second node N2.

The driving switching element Tr_DR is controlled according to the voltage of the second node N2 and is coupled between a first driving power supply line and a third node N3. The first driving power supply line transmits a first driving voltage VDD from a first driving power supply.

The sensing switching element Tr_SS is controlled according to a sense signal from a sense line and is coupled between the first capacitor Cgds and the second node N2.

The initialization switching element TR_IT is controlled according to an initialization signal INT from an initialization line and is coupled between the third node N3 and an initialization power supply line. The initialization power supply line transmits an initialization voltage Vinit.

The reference switching element Tr_RE is controlled according to the initialization signal INT from the initialization line and is coupled between the second node N2 and a reference power supply line. The reference power supply line transmits a reference voltage Vref.

The first capacitor Cgds is coupled between the sensing switching element Tr_SS and the first driving power supply line.

The second capacitor Cem is coupled between the first node N1 and the second node N2.

The third capacitor Cst is coupled between the first node N1 and the third node N3.

If the size of the driving switching element Tr_DR is sufficiently large and thus capacitance of a parasitic capacitor formed between a gate electrode and a drain electrode of the driving switching element Tr_DR is sufficiently large, the parasitic capacitance may perform the function of the first capacitor Cgds. In other words, if the size of the driving switching element Tr-DR is sufficiently large, the first capacitor Cgds may be removed from the circuit of FIG. 2.

The light emitting diode OLED is coupled between the third node N3 and the second driving power supply line. As shown, an anode electrode of the light emitting diode OLED is coupled to the third node N3 and a cathode electrode is coupled to the second driving power supply line. The second driving power supply line transmits a second driving voltage VSS from a second driving power supply.

Figure 3:
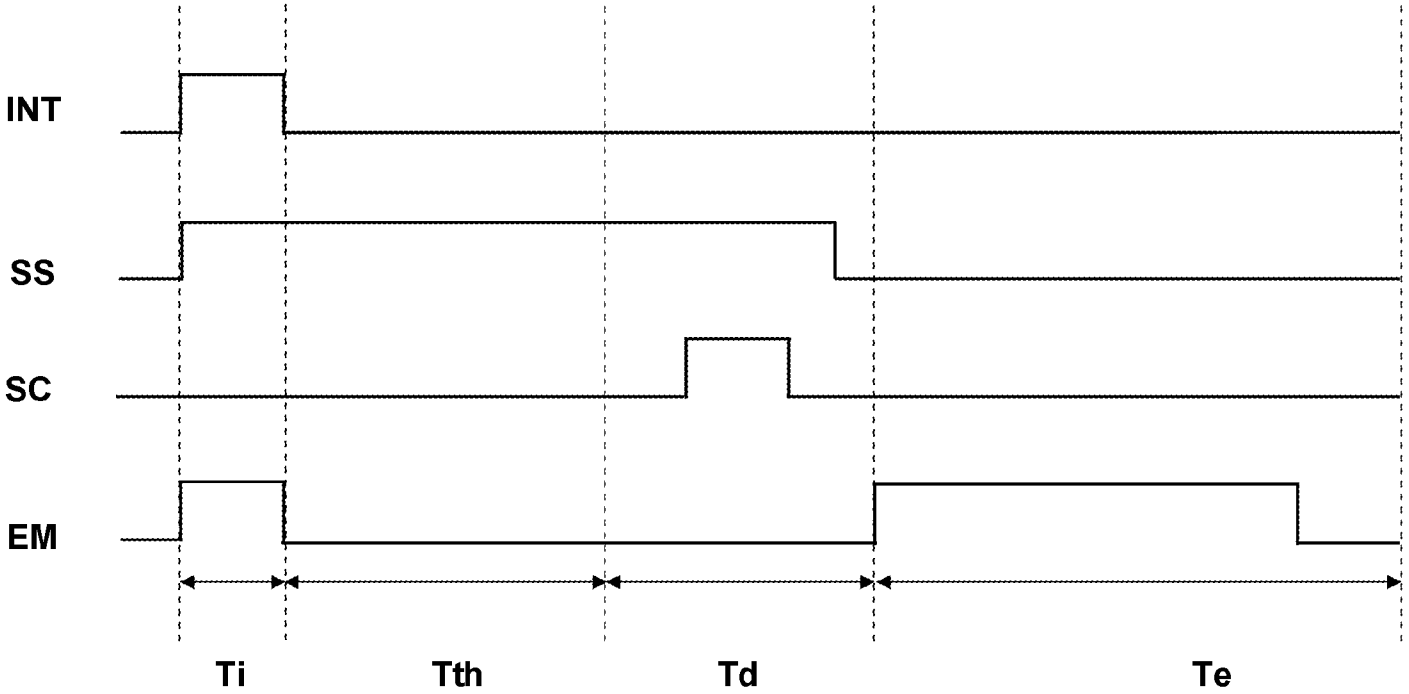
FIG. 3 is an example timing chart of a scan signal, an initialization signal, a light emission control signal EM and a sense signal supplied to the pixel of FIG. 2.

FIG. 3 is an example timing chart of a scan signal SC, an initialization signal INT, a light emission control signal EM and a sense signal SS supplied to a pixel, such as the pixel PXL of FIG. 2.

As shown in FIG. 3, the scan signal SC, the initialization signal INT, the light emission control signal EM and the sense signal SS may be changed to a desired state (e.g., active or inactive) during an initialization period Ti, a threshold voltage detection period Tth, a data writing period Td and a light emission period Te. In one embodiment, the initialization period Ti, the threshold voltage detection period Tth, the data writing period Td and the light emission period Te are sequentially generated. The active state of any signal indicates a state of voltage level capable of turning a switching element on when this signal is supplied to the switching element. The inactive state of any signal indicates a state of voltage level capable of turning a switching element off when this signal is supplied to the switching element. For example, if the switching element is an n-type transistor, the active state of the signal supplied to the switching element means a voltage of a relatively high level and the inactive state means a voltage of a relatively low level.

During the initialization period Ti, the initialization signal INT, the sense signal SS and the light emission control signal EM are maintained in the active state. In contrast, the scan signal SC is maintained in the inactive state.

During the threshold voltage detection period Tth, the sense signal SS is maintained in the active state. In contrast, the initialization signal INT, the scan signal SC and the light emission control signal EM are maintained in the inactive state.

During the data writing period Td, the scan signal SC and the sense signal SS are maintained in the active state. At this time, the scan signal SC and the sense signal SS may not be completely maintained in the active state during the entire data writing period Td, but, as shown in FIG. 3, may be maintained in the active state in a predetermined period of the data writing period Td and maintained in the inactive state in the remaining period. At this time, in the data writing period Td, the period in which the scan signal SC and the sense signal SS are maintained in the active state may be greater than the period in which the scan signal SC and the sense signal SS are maintained in the inactive state. During the data writing period Td, the initialization signal INT and the light emission control signal EM are maintained in the inactive state. Meanwhile, during the data writing period Td, a data signal Vdata is supplied to a data line DL.

During the light emission period Te, the light emission control signal EM is sequentially maintained in an active state and an inactive state. That is, the light emission control signal EM is maintained in the active state when the light emission period Te begins, and changes to the inactive state when a predetermined time has passed. At this time, during the light emission period Te, the period in which the light emission control signal EM is maintained in the active state is greater than the period in which the light emission control signal EM is maintained in the inactive state. During the light emission period Te, the initialization signal INT, the sense signal SS and the scan signal SC are maintained in the inactive state.

In another embodiment, during the light emission period Te, the light emission control signal EM may be continuously maintained in the active state.

One set of signals shown in FIG. 3 is applied to vertically arranged pixels at different timings, which will be described in greater detail with reference to FIG. 4.

Figure 4:
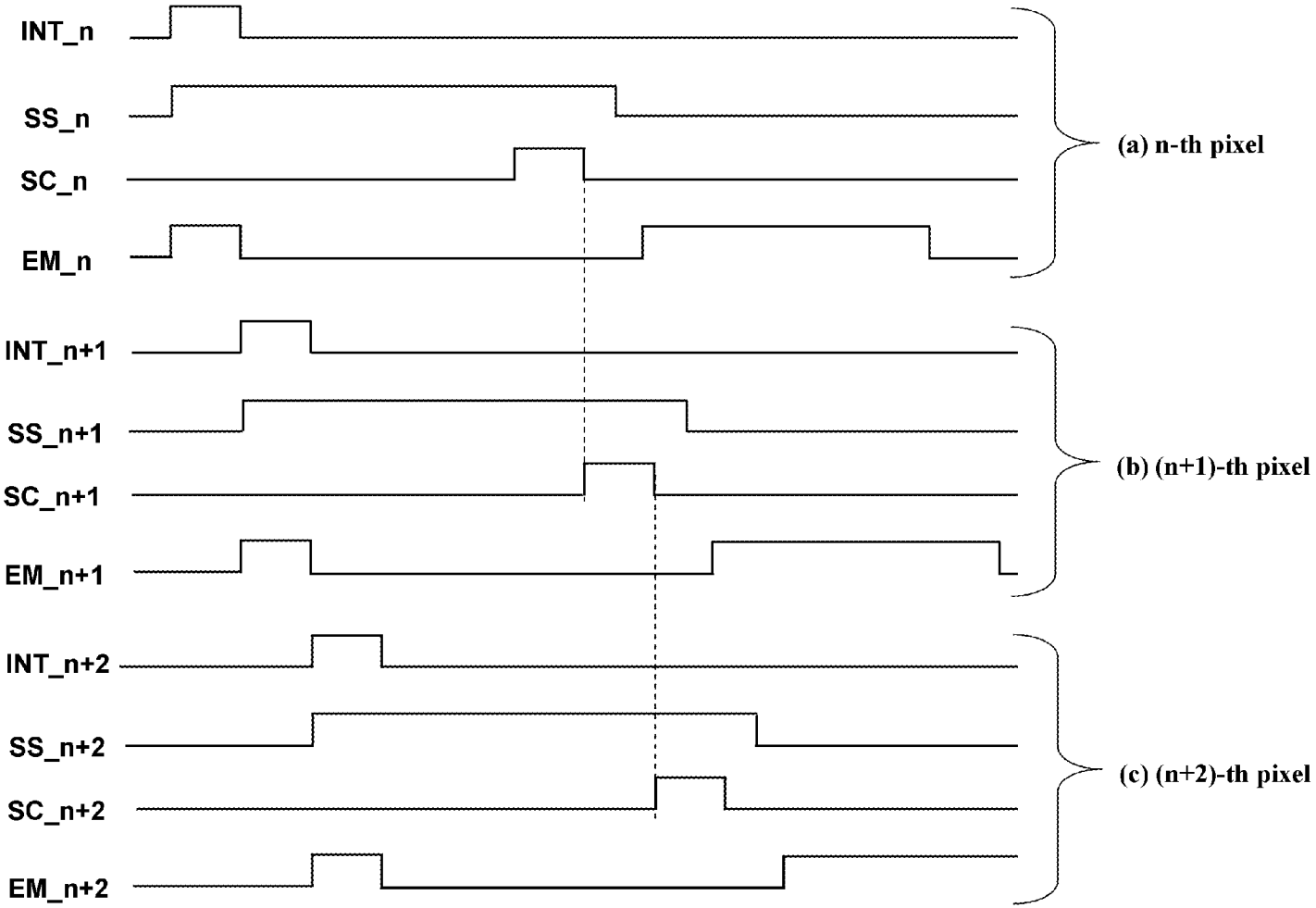
FIG. 4 is an example timing chart of signals applied to pixels when signals of FIG. 3 are supplied to a plurality of vertically arranged pixels.

FIG. 4 is an example timing chart of signals applied to pixels when the signals of FIG. 3 are supplied to a plurality of vertically arranged pixels.

One set of signals IT_n, SS_n, SC_n and EM_n shown in FIG. 4(*a*) is supplied to an n-th pixel, one set of signals IT_n+1, SS_n+1, SC_n+1 and EM_n+1 shown in FIG. 4(*b*) is supplied to an (n+1)-th pixel, and one set of signals IT_n+2, SS_n+2, SC_n+2 and EM_n+2 shown in FIG. 4(*c*) is supplied to an (n+2)-th pixel. The n-th pixel means any one of j pixels located at an n-th pixel row (commonly coupled to an n-th scan line), an (n+1)-th pixel means any one of j pixels located at an (n+1)-th pixel row (commonly coupled to an (n+1)-th scan line), and an (n+2)-th pixel means any one of j pixels located at an (n+2)-th pixel row (commonly coupled to an (n+2)-th scan line).

As shown in FIG. 4, scan signals SC_n, SC_n+1 and SC_n+2 to be supplied to pixels may be sequentially output. More specifically, the scan signal SC_n+1 supplied to the (n+1)-th pixel is output later than the scan signal SC_n supplied to the n-th pixel, and the scan signal SC_n+2 supplied to the (n+2)-th pixel is output later than the scan signal SC_n+1 supplied to the (n+1)-th pixel. The scan signals SC_n, SC_n+1 and SC_n+2 of the pixels are delayed by the respective pulse widths of the active states thereof and then are output. Similarly, the other signals, that is, the initialization signals INT_n, INT_n+1 and INT_n+2, the light emission control signals EM_n, EM_n+1 and EM_n+2 and the sense signals SS_n, SS_n+1 and SS_n+2 are delayed by one pulse width of the scan signals and then are output.

Since one set of signals is delayed and output in every horizontal period, the output timing of the scan signal supplied to any one pixel and the output timing of the initialization signal supplied to another pixel may coincide with each other. In this case, two different kinds of signals may be commonly output using one line, which will be described in detail with reference to FIG. 5.

Figure 5:
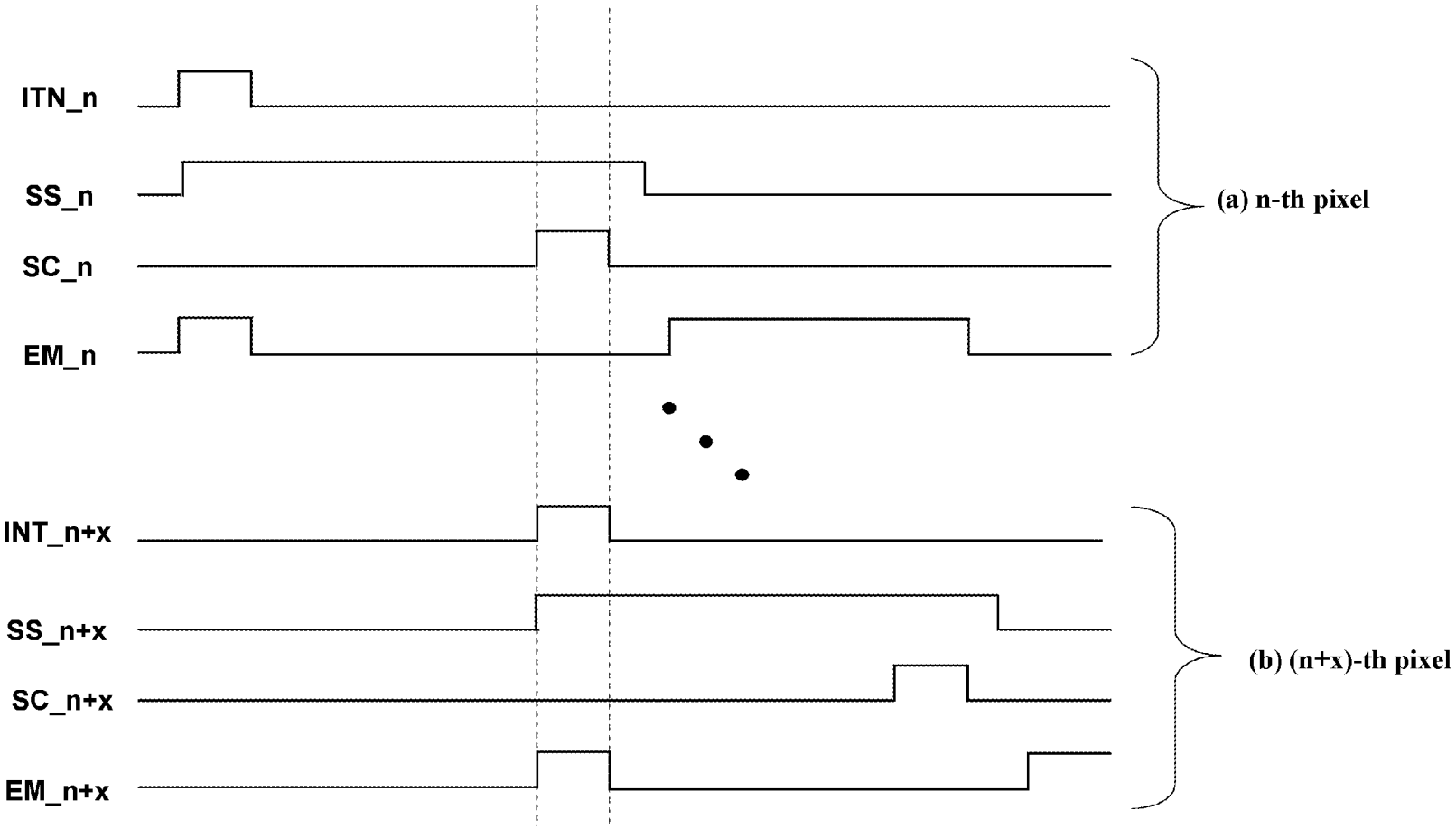
FIG. 5 is an example timing chart of a set of signals supplied to an n-th pixel and a set of signals supplied to an (n+x)-th pixel.

FIG. 5 is an example timing chart of a set of signals supplied to an n-th pixel and a set of signals supplied to an (n+x)-th pixel.

As shown in FIG. 5, the output timing of the scan signal SC_n supplied to the n-th pixel and the output timing of the initialization signal INT_n+x supplied to the (n+x)-th pixel located at the subsequent stage of the n-th pixel coincide with each other and the pulse width of the scan signal SC_n in the active state and the pulse width of the initialization signal INT_n+x in the active state are identical. x is a natural number and may be changed according to the output timings of the signals. If the output timings of different kinds of signals supplied to two different pixels coincide with each other and the pulse widths thereof are identical, for example, the scan signal SC_n supplied to the n-th pixel and the initialization signal INT_n+x supplied to the (n+x)-th pixel may be supplied via the same line. That is, when the scan signal SC_n supplied to the n-th pixel is transmitted by an n-th scan line and the initialization signal INT_n+x supplied to the (n+x)-th pixel are transmitted by an (n+x)-th initialization line, the scan signal SC_n and the initialization signal INT_n+x may be simultaneously transmitted using any one of the n-th scan line and the (n+x)-th initialization line. In this case, the unused line is removed from the circuit, thereby reducing circuit size and cost.

Hereinafter, the operation of the pixel according to the first embodiment will be described in detail with reference to FIGS. 3 and 6A to 6D.

FIGS. 6A to 6D are diagrams illustrating the operation of the pixel according to the first embodiment. In FIGS. 6A to 6D, a switching element shown by a dotted line is turned off and a switching element surrounded by a dotted circle is turned on.

1) Initialization Period Ti

First, the operation of the pixel PXL in the initialization period Ti will be described with reference to FIGS. 3 and 6A.

During the initialization period Ti, as shown in FIG. 3, the initialization signal INT, the sense signal SS and the light emission control signal EM are maintained in the active state. In contrast, the scan signal SC is maintained in the inactive state.

Figure 6A:
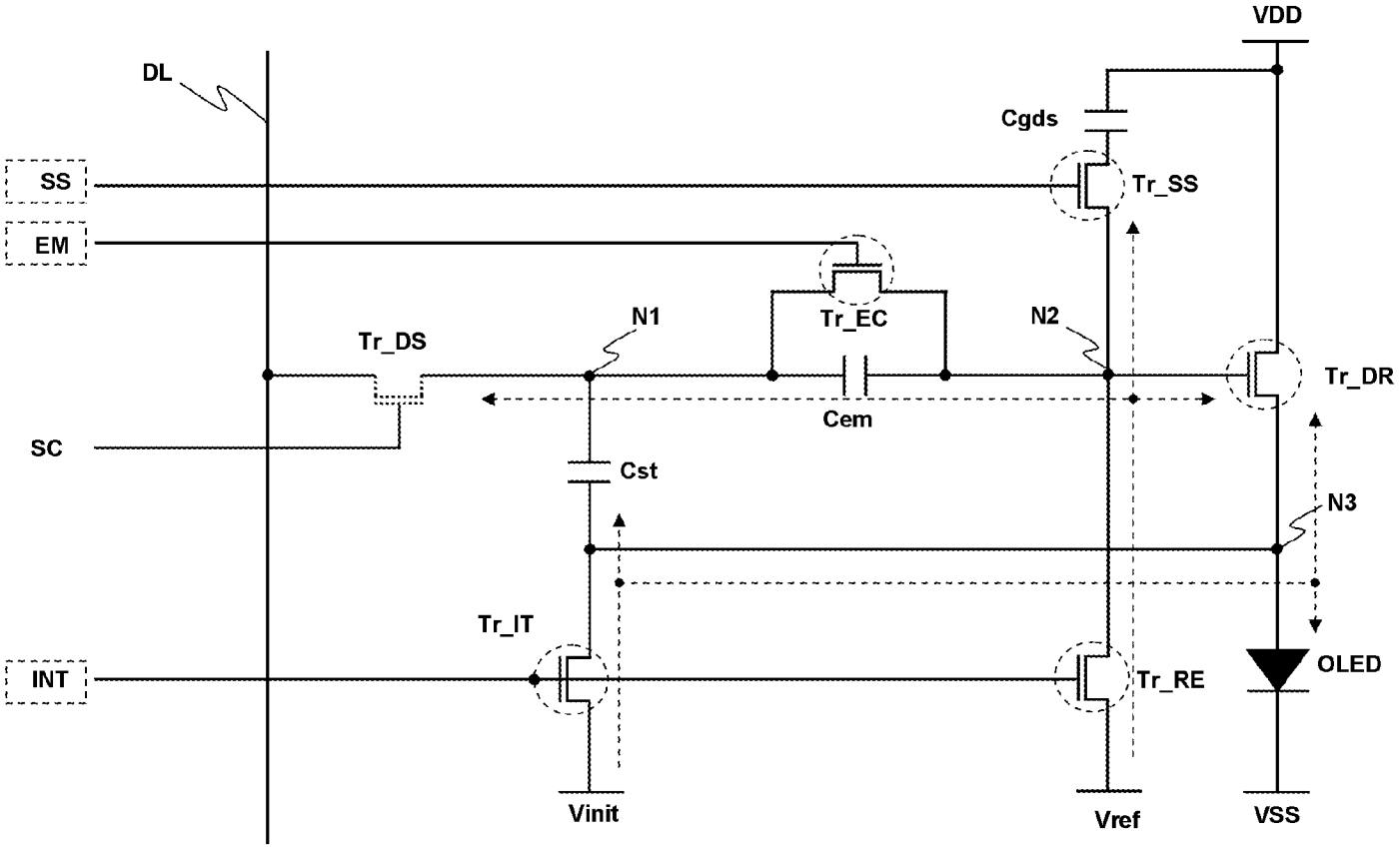
FIGS. 6A to 6D are diagrams illustrating the operation of the pixel according to the first embodiment.

According to such signals, as shown in FIG. 6A, the sensing switching element Tr_SS which receives the sense signal SS of the active state, the light emission control switching element Tr_EC which receives the light emission control signal EM of the active state, the initialization switching element Tr_IT which receives the initialization signal INT of the active state and the reference switching element Tr_RE which receives the initialization signal INT of the active state are turned on. Meanwhile, the data switching element Tr_DS which receives the scan signal SC of the inactive state is turned off.

Then, the reference voltage Vref is supplied to the second node N2 through the turned-on reference switching element Tr_RE. In addition, the reference voltage Vref is supplied to the first node N1 through the turned-on light emission control switching element Tr_EC. Thus, the first node N1 and the second node N2 are maintained at the level of the reference voltage Vref.

The initialization voltage Vinit is supplied to the third node N3 through the turned-on the initialization switching element Tr_IT. The third node N3 is maintained at the level of the initialization voltage Vinit. The level of the initialization voltage Vinit applied to the third node N3 is determined by a ratio of the internal resistance of the driving switching element Tr_DR to the internal resistance of the initialization switching element Tr_IT. In other words, the voltage of the third node N3 is changed according to the threshold voltage Vth of the driving switching element Tr_DR. In particular, the voltage of the third node N3 is saturated to compensate for the threshold voltage Vth.

At this time, since the initialization voltage Vinit is less than the second driving voltage VSS and is less than the threshold voltage of the light emitting diode OLED, the light emitting diode OLED is reversely biased and the light emitting diode OLED is maintained in the off state.

During the initialization period Ti, the second node N2 to which the gate electrode of the driving switching element Tr_DR is coupled is maintained at the level of the reference voltage Vref, the third node N3 to which the source electrode is coupled is maintained at the level of the initialization voltage Vinit, and the drain electrode is maintained at the level of the first driving voltage VDD. Thus, the driving switching element Tr_DR is initialized. At this time, since the voltage difference between the gate electrode and source electrode of the driving switching element Tr_DR exceeds the threshold voltage of the driving switching element Tr_DR, the driving switching element Tr_DR is turned on and initialization current flows through the turned-on driving switching element Tr_DR. At this time, as described above, since the light emitting diode OLED is reversely biased, current generated by the driving switching element Tr_DR does not flow through the light emitting diode OLED and is sunk to an initialization voltage source supplying the initialization voltage Vinit. Since initialization current flows from the first driving power supply line to the initialization power supply line during the initialization period Ti, the driving switching element Tr_DR is initialized regardless of the polarity of the threshold voltage Vth of the driving switching element Tr_DR. That is, even when the threshold voltage Vth of the n-type driving switching element Vth is less than 0 or when the threshold voltage Vth of the p-type driving switching element is greater than 0, the driving switching element Tr_DR is initialized by the above-described initialization current, thereby improving the capability to detect the threshold voltage Vth.

In the initialization period Ti, the light emitting diode OLED is maintained in the off state and the driving switching element Tr_DR is initialized.

In particular, during the initialization period Ti, the third node N3 is discharged to the initialization voltage Vinit having a low value so as to prevent the voltage of the third node N3 from rising even when the driving switching element Tr_DR is turned on. Accordingly, the threshold voltage detection compensation range of the driving switching element Tr_DR is significantly widened.

2) Threshold Voltage Detection Period Tth

Subsequently, the operation of the pixel PXL during the threshold voltage detection period Tth will be described with reference to FIGS. 3 and 6B.

During the threshold voltage detection period Tth, as shown in FIG. 3, the sense signal SS is maintained in the active state. In contrast, the initialization signal INT, the scan signal SC and the light emission control signal EM are maintained in the inactive state.

Figure 6B:
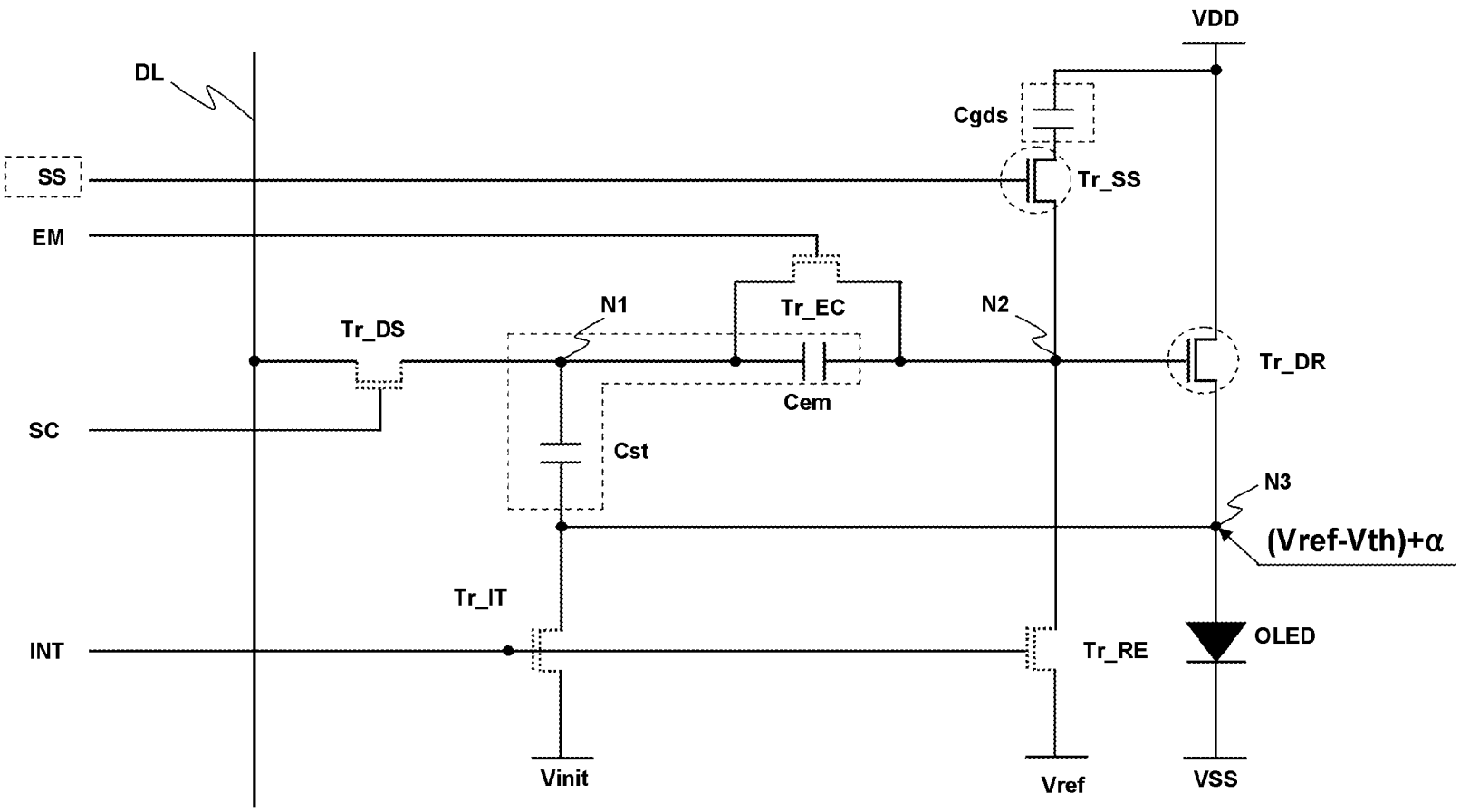

Thus, as shown in FIG. 6B, the sensing switching element Tr_SS which receives the sense signal SS of the active state is maintained in the on state. In contrast, the data switching element Tr_DS, the initialization switching element Tr_IT and the light emission control switching element Tr_EC which receive the scan signal SC, the initialization signal INT and the light emission control signal EM of the inactive state are all turned off. At this time, the driving switching element Tr_DR is maintained in the on state by a difference voltage between the gate electrode (the second node N2) and the source electrode (the third node N3) (that is, a difference voltage between the second node N2 and the third node N3). A current path is formed through the turned-on driving switching element Tr_DR. That is, as shown in FIG. 6B, a current path composed of the second node N2, the driving switching element Tr_DR, the third node N3, the third capacitor Cst and the second capacitor Cem is formed. Thus, the voltages of the second node N2 and the third node N3 begin to rise. At this time, the voltage of the third node N3 is changed to the voltage direction of the second node N2 and thus the threshold voltage Vth of the driving switching element Tr_DR is detected using a source follower method. At this time, the voltage of the second node N2 is determined (rises) by a ratio ((Cst+Cem):Cgds) of series capacitance Cst+Cem between the third capacitor Cst and the second capacitor Cem coupled in series to the capacitance of the first capacitor Cgds. The amount of voltage change at the second node N2 is influenced by the threshold voltage Vth of the driving switching element Tr_DR. For example, if the threshold voltages of the driving switching elements Tr_DR included in any two pixels are different from each other, the amount of voltage change at the second node N2 of each pixel is different from each other. In the threshold voltage detection period Tth, the voltage of the third node N3 rises from the initialization voltage Vinit to $[(Vref-Vth)+\alpha]$. That is, during the threshold voltage detection period Tth, the threshold voltage Vth of the driving switching element Tr_DR is stored in the third node N3. In other words, the voltage of the third node N3 includes the threshold voltage Vth of the driving switching element Tr_DR. Here, "$\alpha$" is an amplification compensation value and the value thereof is increased as the threshold voltage Vth of the driving switching element Tr_DR is increased. In the embodiment illustrated herein, by controlling the ratio ((Cst+Cem):Cgds) of the series capacitance Cst_Cem of the second and third capacitors Cem and Cst to the capacitance of the first capacitor Cgds, it is possible to control the detection capabilities and compensation capabilities of the threshold voltage Vth. Thus, during the threshold voltage detection period Tth, the threshold voltage Vth of the driving switching element Tr_DR is amplified and detected.

3) Data Writing Period Td

Subsequently, the operation of the pixel PXL during the data writing period Td will be described with reference to FIGS. 3 and 6C.

During the data writing period Td, as shown in FIG. 3, the scan signal SC and the sense signal SS are maintained in the active state. At this time, the scan signal SC and the sense signal SS may not be completely maintained in the active state during the entire data writing period Td, but, as shown in FIG. 3, may be maintained in the active state in a predetermined period of the data writing period Td and maintained in the inactive state in the remaining period. In contrast, during the data writing period Td, the initialization signal INT and the light emission control signal EM are maintained in the inactive state. During the data writing period Td, the data signal Vdata is supplied to the data line DL.

Figure 6C:
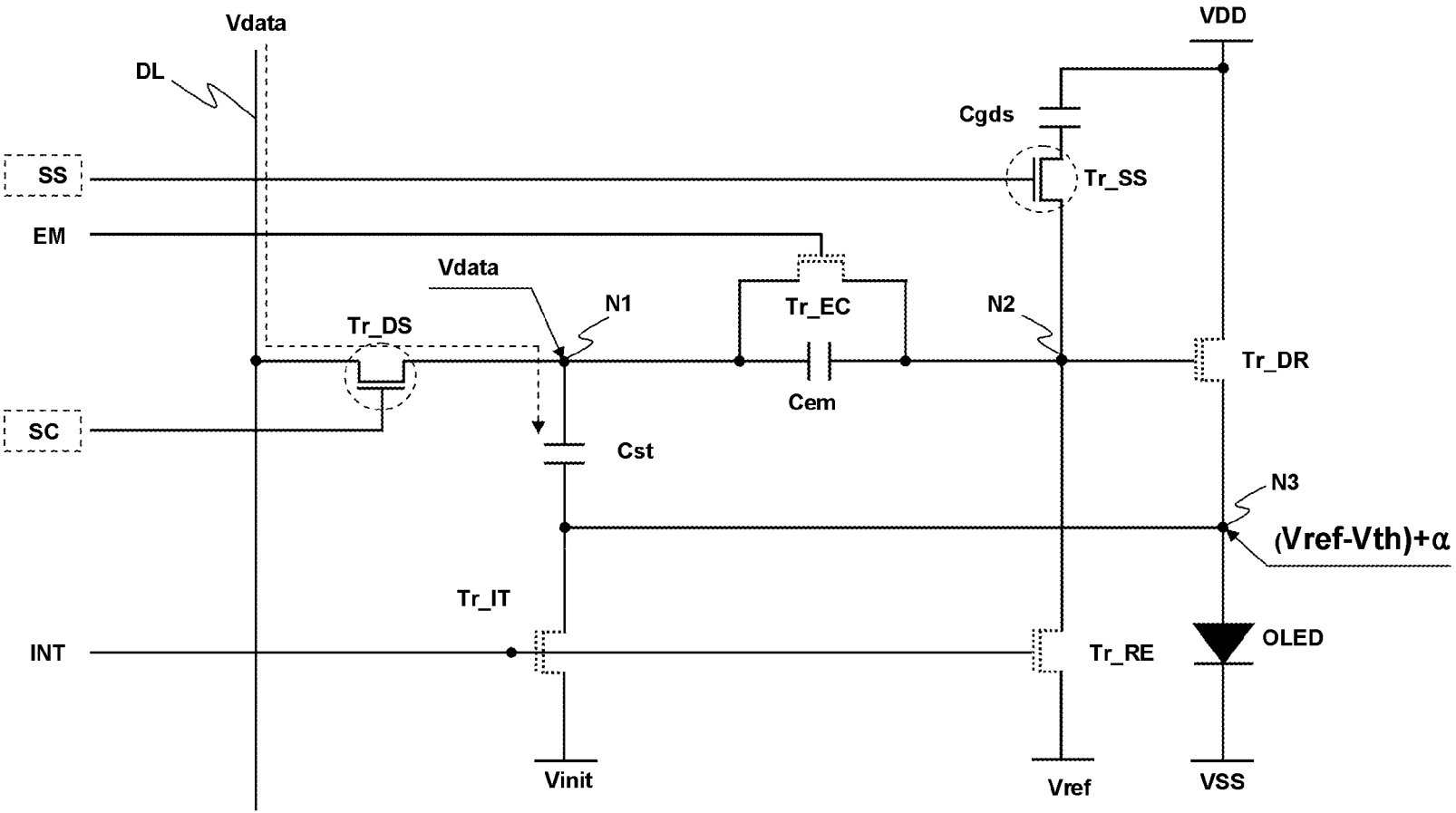

As shown in FIG. 6C, the data switching element Tr_DS which receives the scan signal SC of the active state and the sensing switching element Tr_SS which receives the sense signal SS of the active state are turned on. In contrast, the initialization switching element Tr_IT, the reference switching element Tr_RE and the light emission control switching element Tr_EC which receive the initialization signal INT and the light emission control signal EM of the inactive state are turned off. The driving switching element TR_DR is maintained in the off state.

Then, the data signal Vdata is supplied to the first node N1 through the turned-on data switching element Tr_DS. Thereafter, if the data switching element Tr_DS is turned off as the scan signal SC transitions to the inactive state, the data signal Vdata supplied to the first node N1 is stored in a storage capacitor Cst. At this time, the voltage of the first node N1 may be changed by the input of the data signal Vdata, and the voltage of the second node N2 may be changed by a coupling phenomenon. The voltage change of the second node N2 may cause change in the voltage of the third node N3 so as to cause compensation loss of the threshold voltage Vth. In order to prevent compensation loss, during the data writing period Td, the sensing switching element Tr_SS may be maintained in the on state. That is, since the charges accumulated in the first capacitor Cgds are supplied to the second node N2 by turning the sensing switching element Tr_SS on, it is possible to prevent the voltage of the second node N2 from being changed even when the voltage of the first node N1 is changed. Thus, as the voltage of the first node N1 is changed to reflect the Vdata value, the voltage of the third node N3 set during the detection period may be maintained and thus the compensation loss of the threshold voltage Vth can be prevented.

4) Light Emission Period Te

Figure 6D:
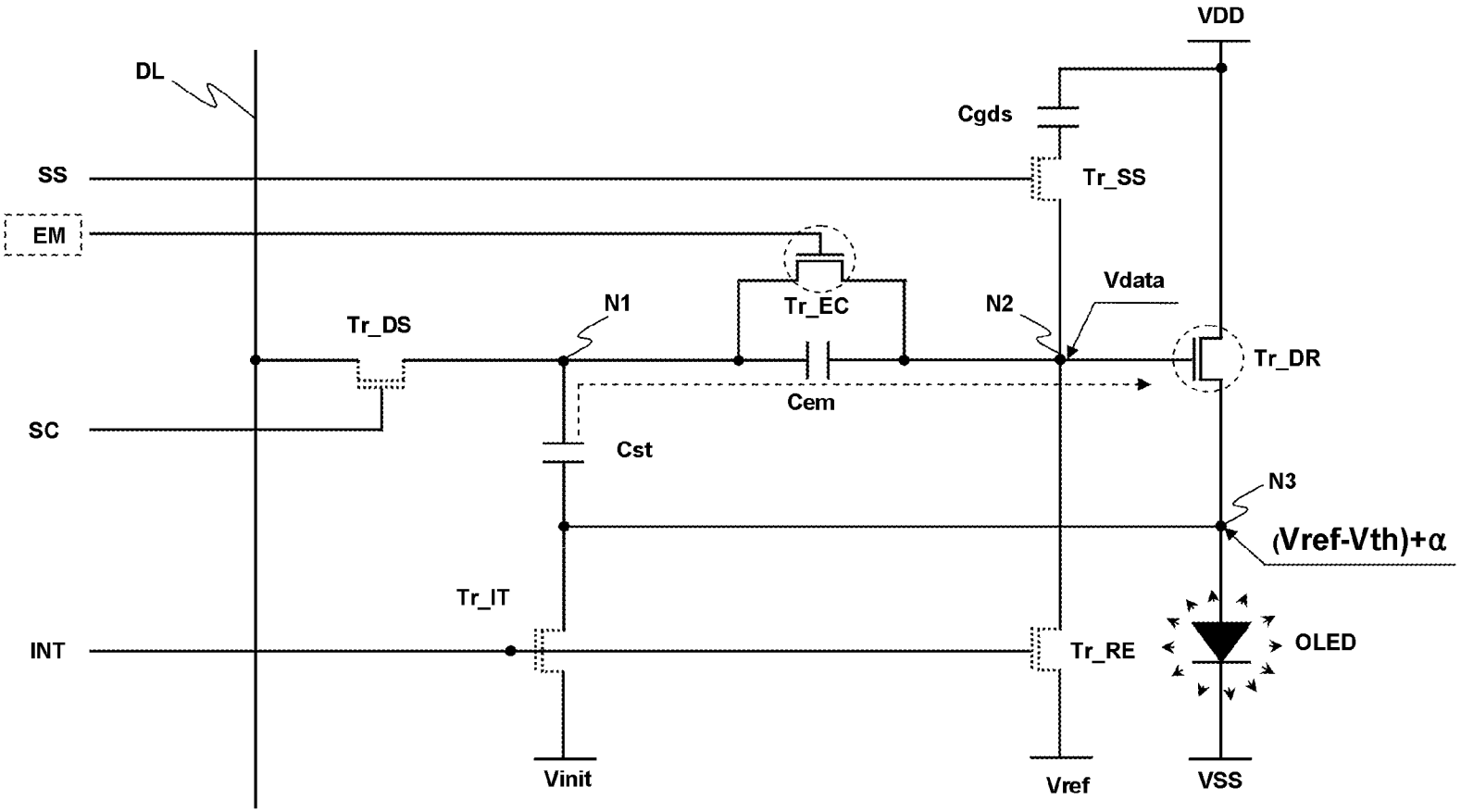

Subsequently, the operation of the pixel PXL during the light emission period Te will be described with reference to FIGS. 3 and 6D.

During the light emission period Te, as shown in FIG. 3, the light emission control signal EM is sequentially in the active state and the inactive state. That is, the light emission control signal EM is maintained in the active state when the light emission period Te begins, and transitions to the inactive state when a predetermined time has passed. In contrast, during the light emission period Te, the initialization signal INT, the sense signal SS and the scan signal SC are maintained in the inactive state.

The light emission control switching element Tr_EC which receives the light emission control signal EM of the active state is turned on. In contrast, the initialization switching element Tr_IT, the reference switching element Tr_RE and the data switching element Tr_DS which receive the initialization signal INT, the sense signal SS and the scan signal SC of the inactive state are all turned off.

Then, the data signal Vdata of the first node N1 is applied to the second node N2 through the turned-on light emission control switching element Tr_EC. Then, the driving switching element Tr_DR is turned on by a voltage difference Vgs between the second node N2 and the third node N3, and the turned-on driving switching element Tr_DR generates driving current according to the data signal Vdata applied thereto. At this time, the voltage difference Vgs between the second node N2 and the third node N3 is Vdata−((Vref−Vth)+α). As the driving current of the driving switching element Tr_DR is supplied to the light emitting diode OLED, the light emitting diode OLED begins to emit light. At this time, after the quantity of the electric charges generated by the data signal and the threshold voltage Vth are sent to the second node N2, the light emission switching element Tr_EC are turned off and thus the light emission period is maintained in a state in which all switching elements are in the off state.

During the light emission period Te, the voltage of the second node N2 is held by the parasitic capacitor of the driving switching element Tr_DR and the second and third capacitors Cem and Cst.

In sum, as described above, the voltage Vdata−((Vref−Vth)+α) is stored across the capacitor Cst during the light emission period Te. The second node N2 is coupled to the gate terminal of the driving transistor Tr_DR, thus driving the gate-source voltage Vgs to Vdata−((Vref−Vth)+α) or Vdata−C+Vth where C is a constant Vref+α. During the light emission period Te, the current through the driving transistor Tr_DR is substantially proportional (Vgs−Vth)=(Vdata−C) where C is the constant (Vref+α). Accordingly, for any two driving transistors of two different pixels of a display device with differing threshold voltage Vth values, their resulting currents are substantially similar for the same Vdata value. As a result, the light emitting element may be driven by a current value, Id, proportional to Vdata, independent of the threshold voltage value Vth of the drive transistor Tr_DR.

Second Embodiment

Figure 7:
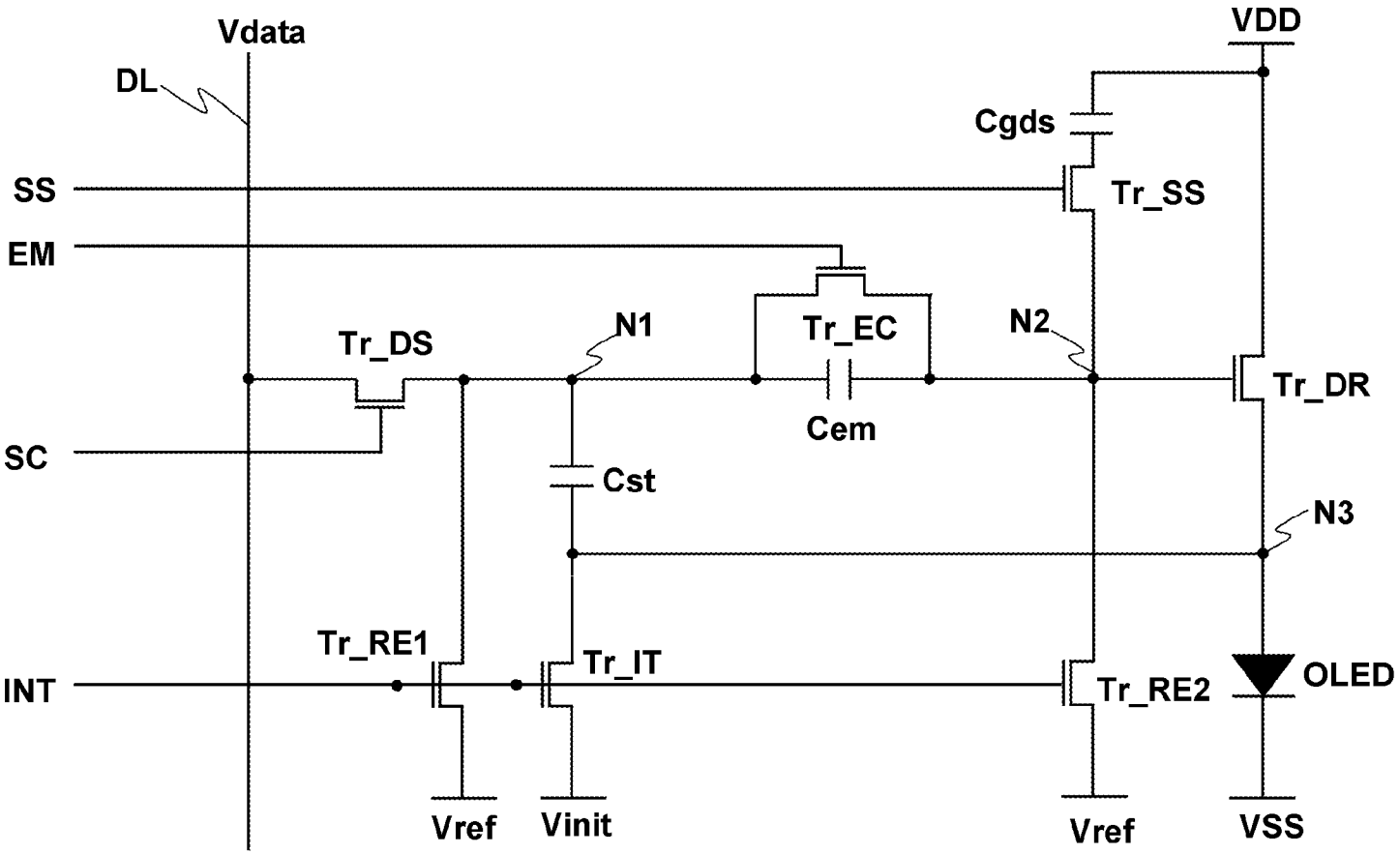
FIG. 7 is a diagram showing a circuit configuration of a pixel according to a second embodiment.

FIG. 7 is a diagram showing a circuit configuration of a pixel according to a second embodiment. FIG. 7 shows the circuit configuration of any one pixel PXL.

One pixel PXL includes a data switching element Tr_DS, a light emission control switching element Tr_EC, a driving switching element Tr_DR, a sensing switching element Tr_SS, an initialization switching element TR_IT, a first reference switching element Tr_RE1, a second reference switching element Tr_RE2, a first capacitor Cgds, a second capacitor Cem, a third capacitor Cst and a light emitting diode OLED, as shown in FIG. 7. The data switching element Tr_DS, the light emission control switching element Tr_EC, the driving switching element Tr_DR, the sensing switching element Tr_SS, the initialization switching element TR_IT, the first reference switching element Tr_RE1 and the second reference switching element Tr_RE2 are all n type transistors.

The data switching element Tr_DS is controlled according to a scan signal SC from a scan line and is coupled between a data line DL and a first node N1.

The light emission control switching element Tr_EC is controlled according to a light emission control signal EM from a light emission control line and is coupled between the first node N1 and a second node N2.

The driving switching element Tr_DR is controlled according to the voltage of the second node N2 and is coupled between a first driving power supply line and a third node N3. The first driving power supply line transmits a first driving voltage VDD from a first driving power supply.

The sensing switching element Tr_SS is controlled according to a sense signal from a sense line and is coupled between the first capacitor Cgds and the second node N2.

The initialization switching element TR_IT is controlled according to an initialization signal INT from an initialization line and is coupled between the third node N3 and an initialization power supply line. The initialization power supply line transmits an initialization voltage Vinit.

The first reference switching element Tr_RE1 is controlled according to the initialization signal INT from the initialization line and is coupled between the first node N1 and a reference power supply line. The reference power supply line transmits a reference voltage Vref.

The second reference switching element Tr_RE2 is controlled according to the initialization signal INT from the initialization line and is coupled between the second node N2 and the reference power supply line.

The first capacitor Cgds is coupled between the sensing switching element Tr_SS and the first driving power supply line.

The second capacitor Cem is coupled between the first node N1 and the second node N2.

The third capacitor Cst is coupled between the first node N1 and the third node N3.

If the size of the driving switching element Tr_DR is sufficiently large and thus capacitance of a parasitic capacitor formed between a gate electrode and a drain electrode of the driving switching element Tr_DR is sufficiently large, this parasitic capacitor may replace the first capacitor Cgds. In other words, if the size of the driving switching element Tr-DR is sufficiently large, the first capacitor Cgds may be removed from the circuit of FIG. 2.

The light emitting diode OLED is coupled between the third line N3 and the second driving power supply line. At this time, an anode electrode of the light emitting diode OLED is coupled to the third node N3 and a cathode electrode is coupled to the second driving power supply line. The second driving power supply line transmits a second driving voltage from a second driving power supply.

Figure 8:
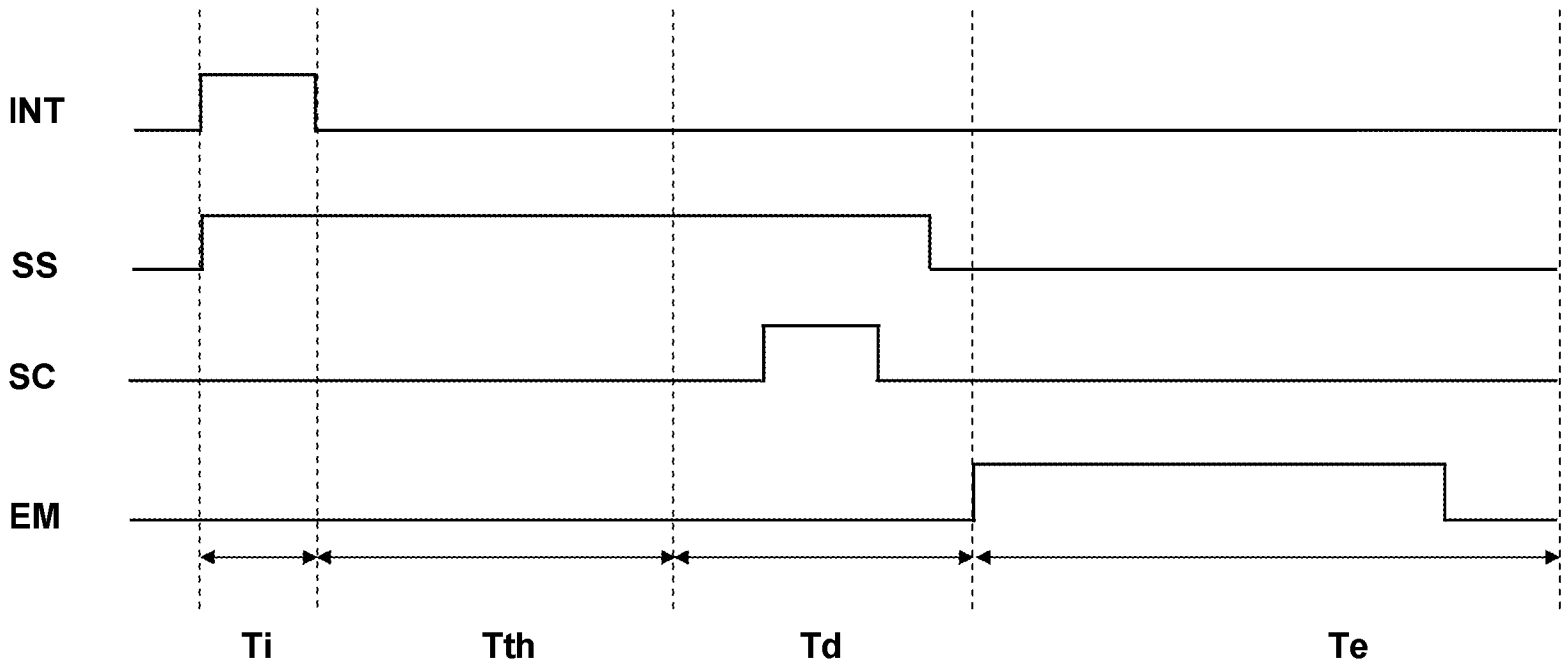
FIG. 8 is an example timing chart of a scan signal, an initialization signal, a light emission control signal and a sense signal supplied to the pixel of FIG. 7.

FIG. 8 is an example timing chart of a scan signal SC, an initialization signal INT, a light emission control signal EM and a sense signal SS supplied to a pixel, such as the pixel illustrated in FIG. 7.

As shown in FIG. 8, the scan signal SC, the initialization signal INT, the light emission control signal EM and the sense signal SS are changed to an active state or an inactive state based on an initialization period Ti, a threshold voltage detection period Tth, a data writing period Td and a light emission period Te. The initialization period Ti, the threshold voltage detection period Tth, the data writing period Td and the light emission period Te are sequentially generated. The active state of any signal means a state of a level capable of turning a switching element on when this signal is supplied to the switching element. The inactive state of any signal means a state of a level capable of turning a switching element off when this signal is supplied to the switching element. For example, if the switching element is of an n type, the active state of the signal supplied to the switching element means a voltage of a relatively high level and the inactive state means a voltage of a relatively low level.

During the initialization period Ti, the initialization signal INT and the sense signal SS are maintained in the active state. In contrast, the scan signal SC and the light emission control signal EM are maintained in the inactive state.

During the threshold voltage detection period Tth, the sense signal SS is maintained in the active state. In contrast, the initialization signal INT, the scan signal SC and the light emission control signal EM are maintained in the inactive state.

During the data writing period Td, the scan signal SC and the sense signal SS are maintained in the active state. At this time, the scan signal SC and the sense signal SS may not be completely maintained in the active state during the entire data writing period Td, but, as shown in FIG. 3, may be maintained in the active state in a predetermined period of the data writing period Td and maintained in the inactive state in the remaining period. At this time, in the data writing period Td, the period in which the scan signal SC and the sense signal SS are maintained in the active state may be greater than the period in which the scan signal SC and the sense signal SS are maintained in the inactive state. During the data writing period Td, the initialization signal INT and the light emission control signal EM are maintained in the inactive state. Meanwhile, during the data writing period Td, a data signal Vdata is supplied to a data line DL.

During the light emission period Te, the light emission control signal EM is sequentially maintained in an active state and an inactive state. That is, the light emission control signal EM is maintained in the active state when the light emission period Te begins, and transitions to the inactive state when a predetermined time has passed. At this time, in the light emission period Te, the period in which the light emission control signal EM is maintained in the active state is greater than the period in which the light emission control signal EM is maintained in the inactive state. During the light emission period Te, the initialization signal INT, the sense signal SS and the scan signal SC are maintained in the inactive state.

As another embodiment, during the light emission period Te, the light emission control signal EM may be continuously maintained in the active state.

Hereinafter, the operation of the pixel according to the second embodiment will be described in detail with reference to FIGS. 8 and 9A to 9D.

FIGS. 9A to 9D are diagrams illustrating the operation of the pixel according to the second embodiment. In FIGS. 9A to 9D, a switching element shown by a dotted line is turned off and a switching element surrounded by a dotted circle is turned on.

1) Initialization Period Ti

First, the operation of the pixel PXL in the initialization period Ti will be described with reference to FIGS. 8 and 9A.

During the initialization period Ti, as shown in FIG. 8, the initialization signal INT and the sense signal SS are maintained in the active state. In contrast, the scan signal SC and the light emission control signal EM are maintained in the inactive state.

Figure 9A:
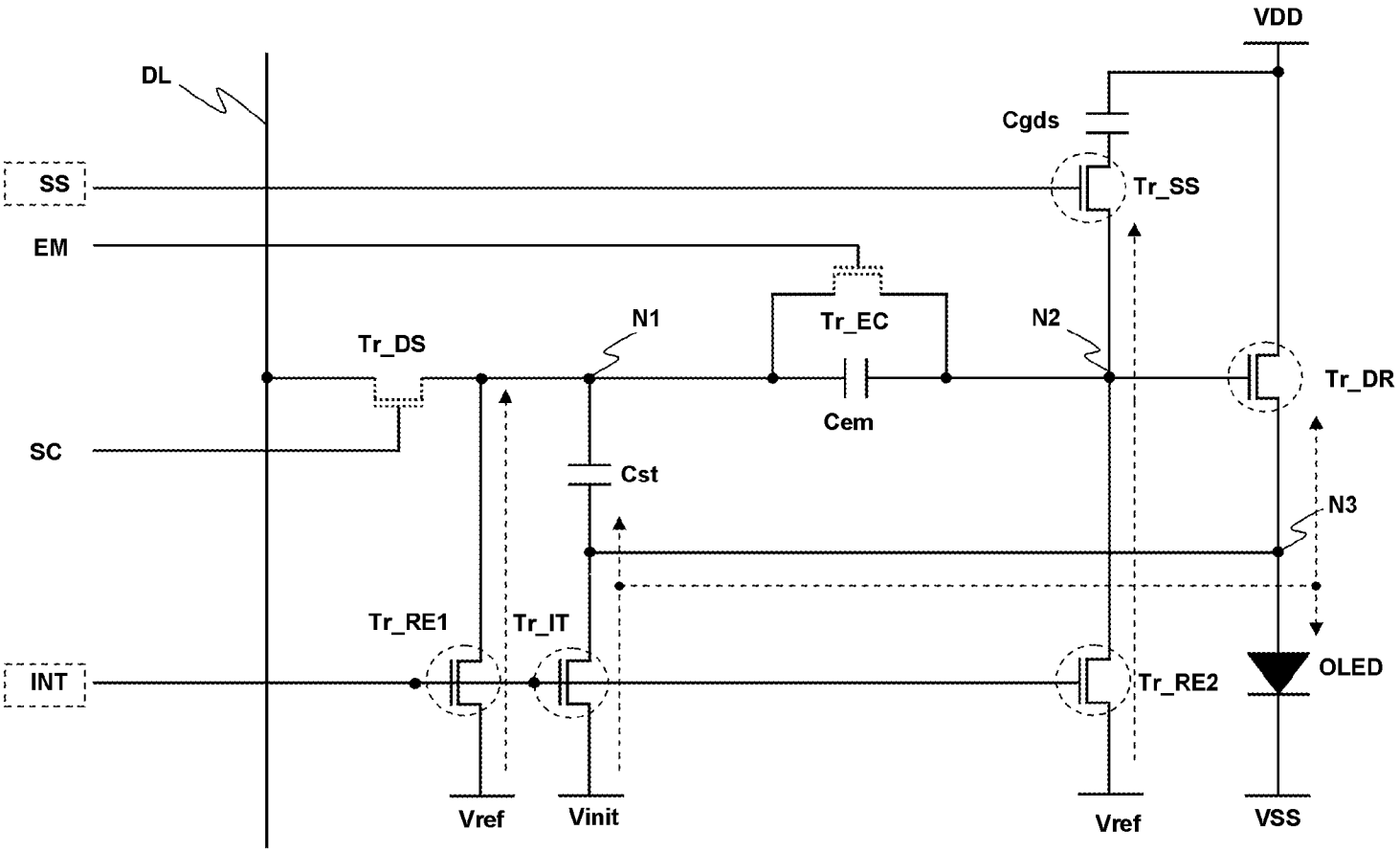
FIGS. 9A to 9D are diagrams illustrating the operation of the pixel according to the second embodiment.

According to such signals, as shown in FIG. 9A, the sensing switching element Tr_SS which receives the sense signal SS of the active state, and the initialization switching element Tr_IT, the first reference switching element Tr_RE1 and the second reference switching element Tr_RE2, all of which receive the initialization signal INT of the active state, are turned on. Meanwhile, the data switching element Tr_DS and the light emission control switching element Tr_EC which receive the scan signal SC and the light emission control signal EM of the inactive state are turned off.

Then, the reference voltage Vref is supplied to the first node N1 through the turned-on first reference switching element Tr_RE1. In addition, the reference voltage Vref is supplied to the second node N2 through the turned-on second reference switching element Tr_RE2. Thus, the first node N1 and the second node N2 are maintained at the level of the reference voltage Vref.

The initialization voltage Vinit is supplied to the third node N3 through the turned-on initialization switching element Tr_IT. The third node N3 is maintained at the level of the initialization voltage Vinit. The level of the initialization voltage Vinit applied to the third node N3 is determined by a ratio of the internal resistance of the driving switching element Tr_DR to the internal resistance of the initialization switching element Tr_IT. In other words, the voltage of the third node N3 is changed according to the threshold voltage Vth of the driving switching element Tr_DR. In particular, the voltage of the third node N3 is saturated to compensate for the threshold voltage Vth.

At this time, since the initialization voltage Vinit is less than the second driving voltage VSS and is less than the threshold voltage of the light emitting diode OLED, the light emitting diode OLED is reversely biased and the light emitting diode OLED is maintained in the off state.

During the initialization period Ti, the second node N2 to which the gate electrode of the driving switching element Tr_DR is coupled is maintained at the level of the reference voltage Vref, the third node N3 to which the source electrode is coupled is maintained at the level of the initialization voltage Vinit, and the drain electrode is maintained at the level of the first driving voltage VDD. Thus, the driving switching element Tr_DR is initialized. At this time, since the voltage difference between the gate electrode and source electrode of the driving switching element Tr_DR exceeds the threshold voltage of the driving switching element Tr_DR, the driving switching element Tr_DR is turned on and initialization current flows through the turned-on driving switching element Tr_DR. At this time, as described above, since the light emitting diode OLED is reversely biased, current generated by the driving switching element Tr_DR does not flow through the light emitting diode OLED and is sunk to an initialization voltage source supplying the initialization voltage Vinit. Since initialization current flows from the first driving power supply line to the initialization power supply line during the initialization period Ti, the driving switching element Tr_DR is initialized regardless of the polarity of the threshold voltage Vth of the driving switching element Tr_DR. That is, even when the threshold voltage Vth of the n-type driving switching element Vth is less than 0 or when the threshold voltage Vth of the p-type driving switching element is greater than 0, the driving switching element Tr_DR is initialized by the above-described initialization current, thereby improving detection capabilities of the threshold voltage Vth.

In the initialization period Ti, the light emitting diode OLED is maintained in the off state and the driving switching element Tr_DR is initialized.

In particular, during the initialization period Ti, the third node N3 is discharged to the initialization voltage Vinit having a low value so as to prevent the voltage of the third node N3 from rising even when the driving switching element Tr_DR is turned on. Accordingly, the threshold voltage detection compensation range of the driving switching element Tr_DR is significantly widened.

2) Threshold Voltage Detection Period Tth

Figure 9B:
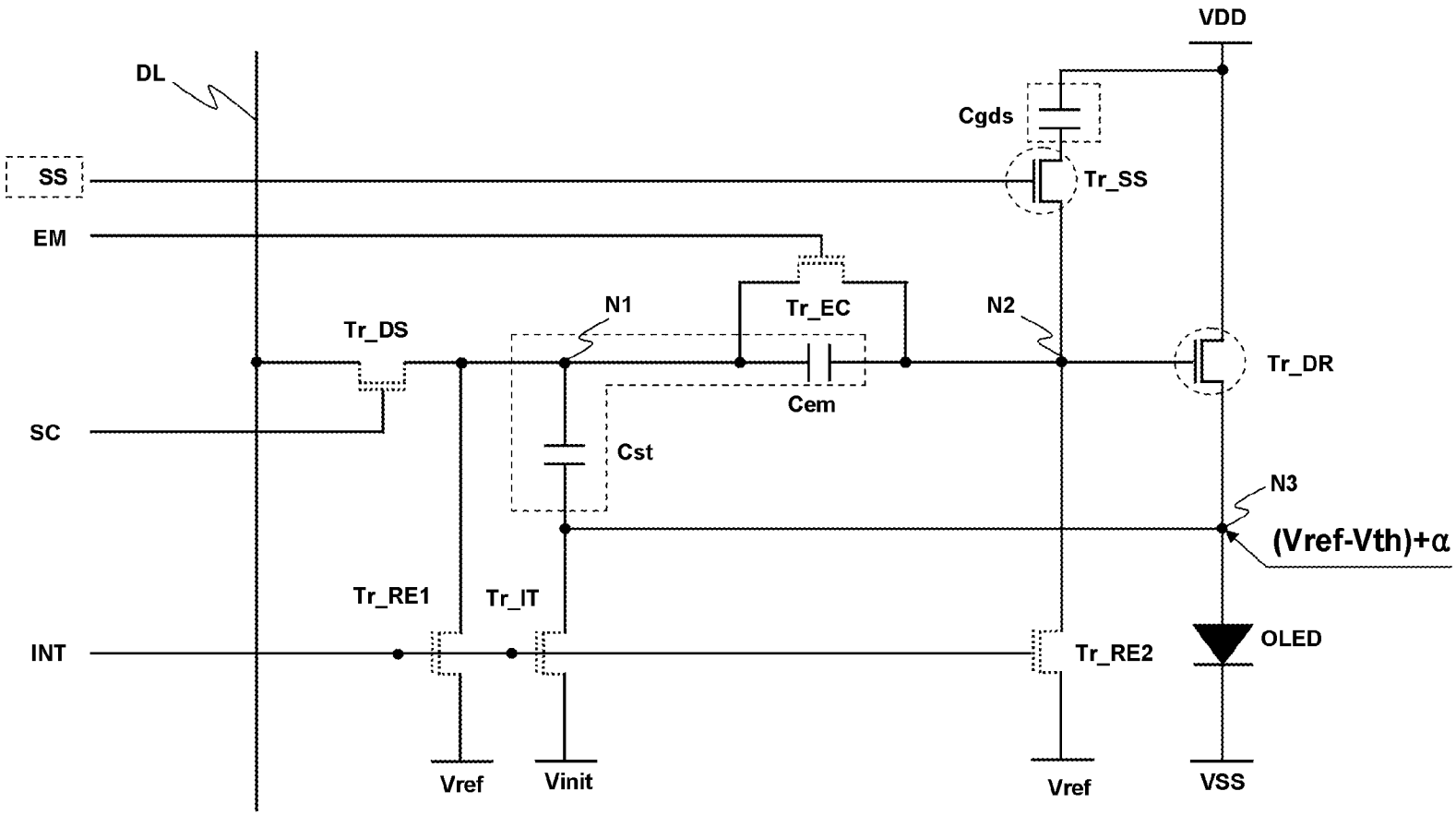

Subsequently, the operation of the pixel PXL during the threshold voltage detection period Tth will be described with reference to FIGS. 8 and 9B. Since the operation of the pixel during the threshold voltage detection period Tth of the second embodiment is similar to that of the first embodiment of FIG. 6B, description thereof is omitted for brevity.

3) Data Writing Period Td

Figure 9C:
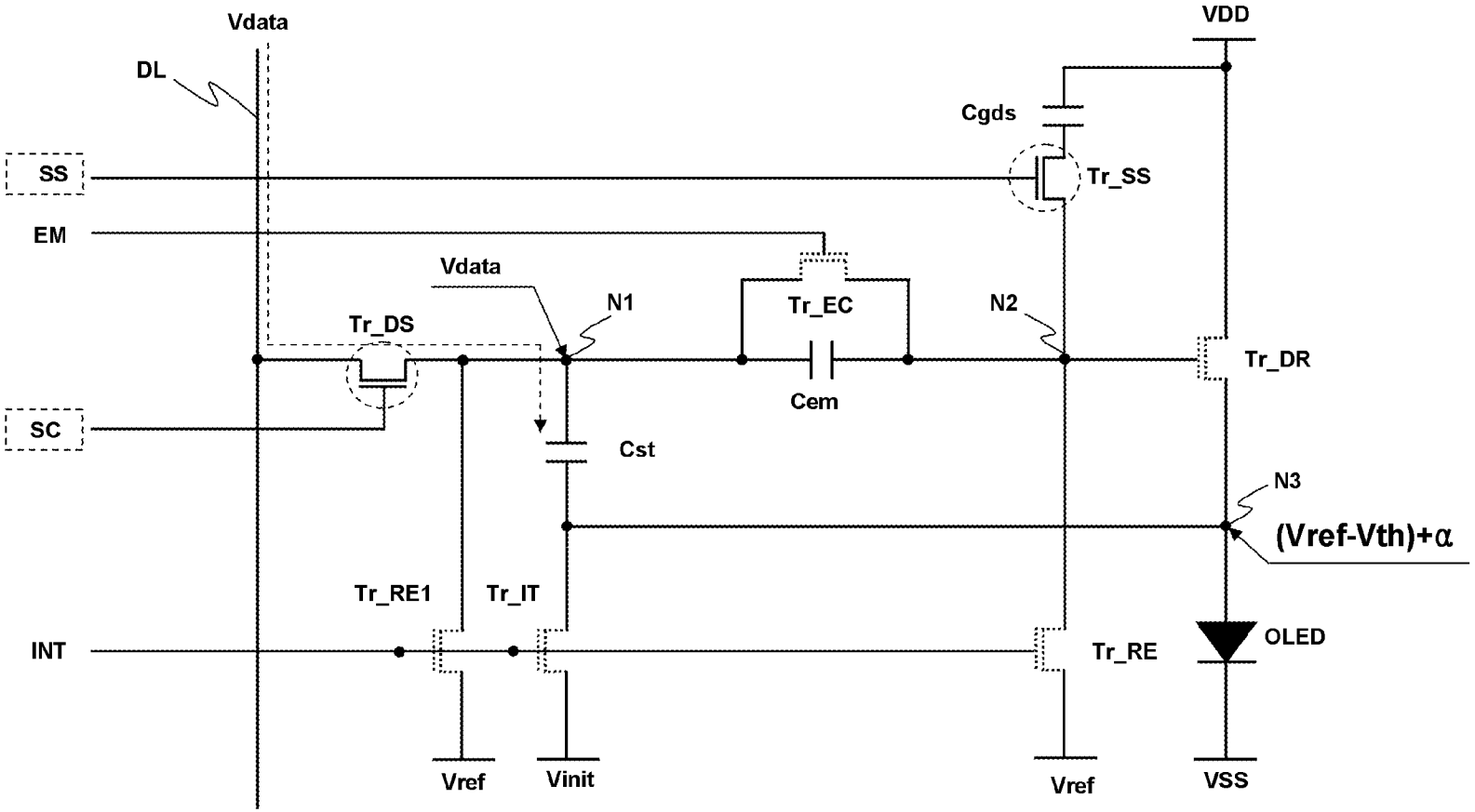

Subsequently, the operation of the pixel PXL during the data writing period Td will be described with reference to FIGS. 8 and 9C. Since the operation of the pixel during the data writing period Td of the second embodiment is similar to that of the first embodiment of FIG. 6C, description thereof is omitted for brevity.

4) Light Emission Period Te

Figure 9D:
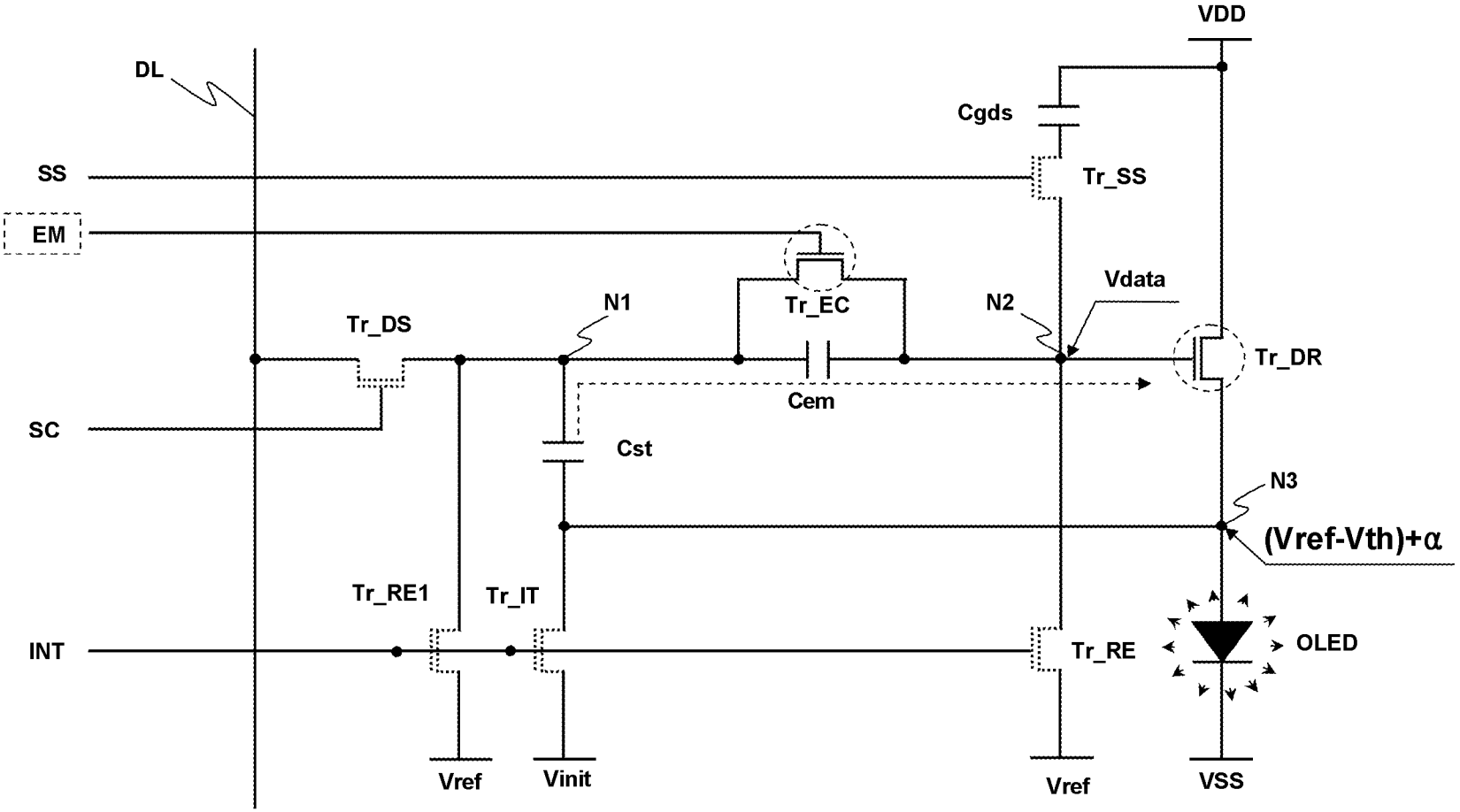

Subsequently, the operation of the pixel PXL in the light emission period Te will be described with reference to FIGS. 8 and 9D. Since the operation of the pixel during the light emission period Te of the second embodiment is similar to that of the first embodiment of FIG. 6D, description thereof is omitted for brevity.

Third Embodiment

Figure 10:
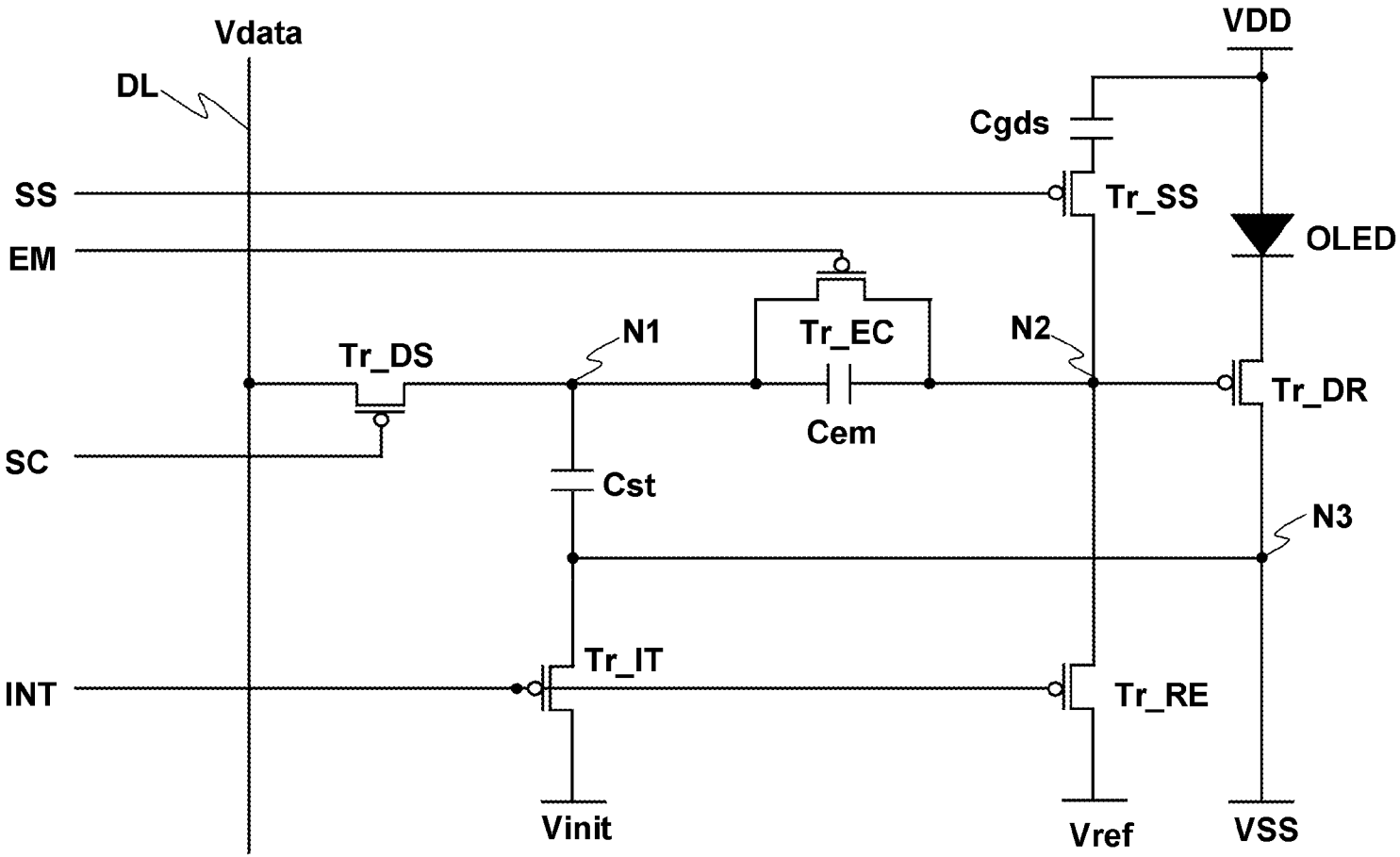
FIG. 10 is a diagram showing a circuit configuration of a pixel according to a third embodiment.

FIG. 10 is an example diagram showing a circuit configuration of a pixel according to a third embodiment. FIG. 10 shows the circuit configuration of any one pixel PXL of FIG. 1.

The circuit configuration of the pixel according to the third embodiment includes a data switching element Tr_DS, a light emission control switching element Tr_EC, a driving switching element Tr_DR, a sensing switching element Tr_SS, an initialization switching element TR_IT, a reference switching element Tr_RE, a first capacitor Cgds, a second capacitor Cem, a third capacitor Cst and a light emitting diode OLED, as shown in FIG. 10. The data switching element Tr_DS, the light emission control switching element Tr_EC, the driving switching element Tr_DR, the sensing switching element Tr_SS, the initialization switching element TR_IT and the reference switching element Tr_RE are all p type transistors. The anode electrode of the light emitting diode OLED is coupled to a first driving power supply line for transmitting a first driving voltage VDD and a cathode electrode is coupled to the driving switching element Tr_DR. The remaining components are similar to those of the first embodiment described above.

Figure 11:
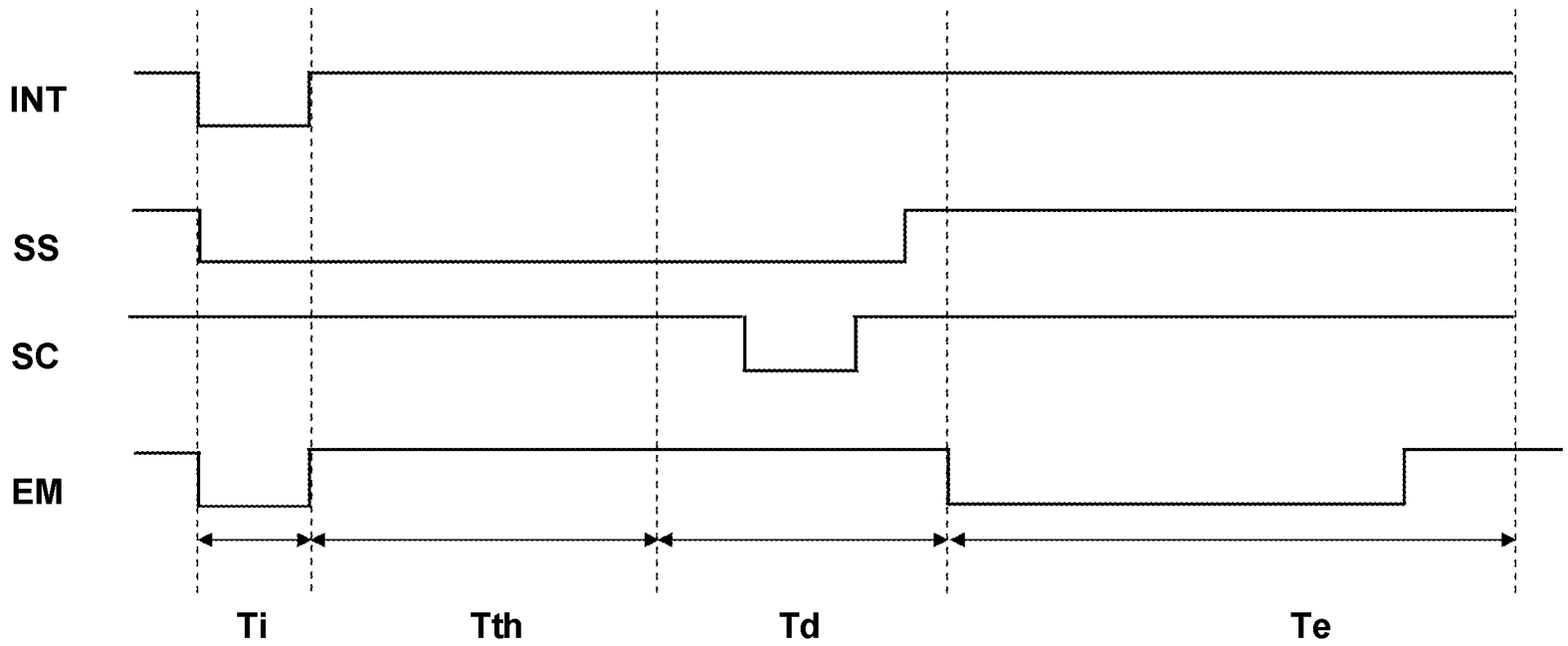
FIG. 11 is an example timing chart of a scan signal, an initialization signal, a light emission control signal and a sense signal supplied to the pixel of FIG. 10.

FIG. 11 is an example timing chart of a scan signal SC, an initialization signal INT, a light emission control signal EM and a sense signal SS supplied to a pixel, such as the pixel illustrated in FIG. 10.

As shown in FIG. 11, the initialization signal INT, the sense signal SS, the scan signal SC and the light emission control signal EM are changed to an active state or an inactive state based on an initialization period Ti, a threshold voltage detection period Tth, a data writing period Td and a light emission period Te, all of which are sequentially generated. The active state of any signal of FIG. 11 means a low voltage level. The timing chart of FIG. 11 is equal to that of FIG. 3 except that the active state is set to a low voltage. As another embodiment, the light emission control signal EM may be continuously maintained in the active state during the light emission period Te of FIG. 11.

Fourth Embodiment

Figure 12:
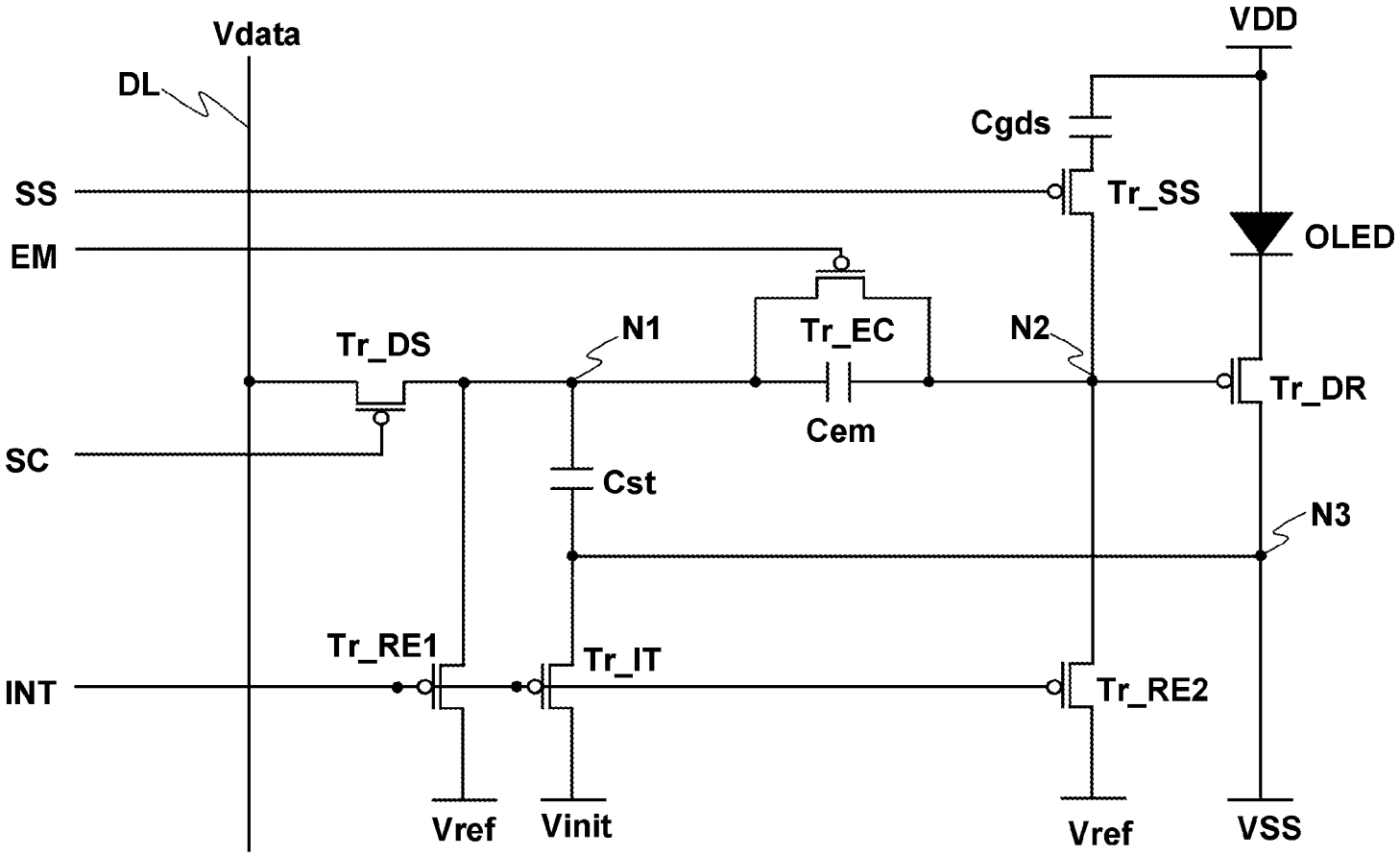
FIG. 12 is a diagram showing a circuit configuration of pixels according to a fourth embodiment.

FIG. 12 is a diagram showing a circuit configuration of pixels according to a fourth embodiment. FIG. 12 shows the circuit configuration of any one pixel PXL of FIG. 1.

The circuit configuration of the pixel according to the fourth embodiment includes a data switching element Tr_DS, a light emission control switching element Tr_EC, a driving switching element Tr_DR, a sensing switching element Tr_SS, an initialization switching element TR_IT, a first reference switching element Tr_RE1, a second reference switching element Tr_RE2, a first capacitor Cgds, a second capacitor Cem, a third capacitor Cst and a light emitting diode OLED, as shown in FIG. 12. The data switching element Tr_DS, the light emission control switching element Tr_EC, the driving switching element Tr_DR, the sensing switching element Tr_SS, the initialization switching element TR_IT, the first reference switching element Tr_RE1 and the second reference switching element Tr_RE2 are are all p type transistors. The anode electrode of the light emitting diode OLED is coupled to a first driving power supply line for transmitting a first driving voltage VDD and a cathode electrode is coupled to the driving switching element Tr_DR. The remaining components are similar to those of the second embodiment described above.

Figure 13:
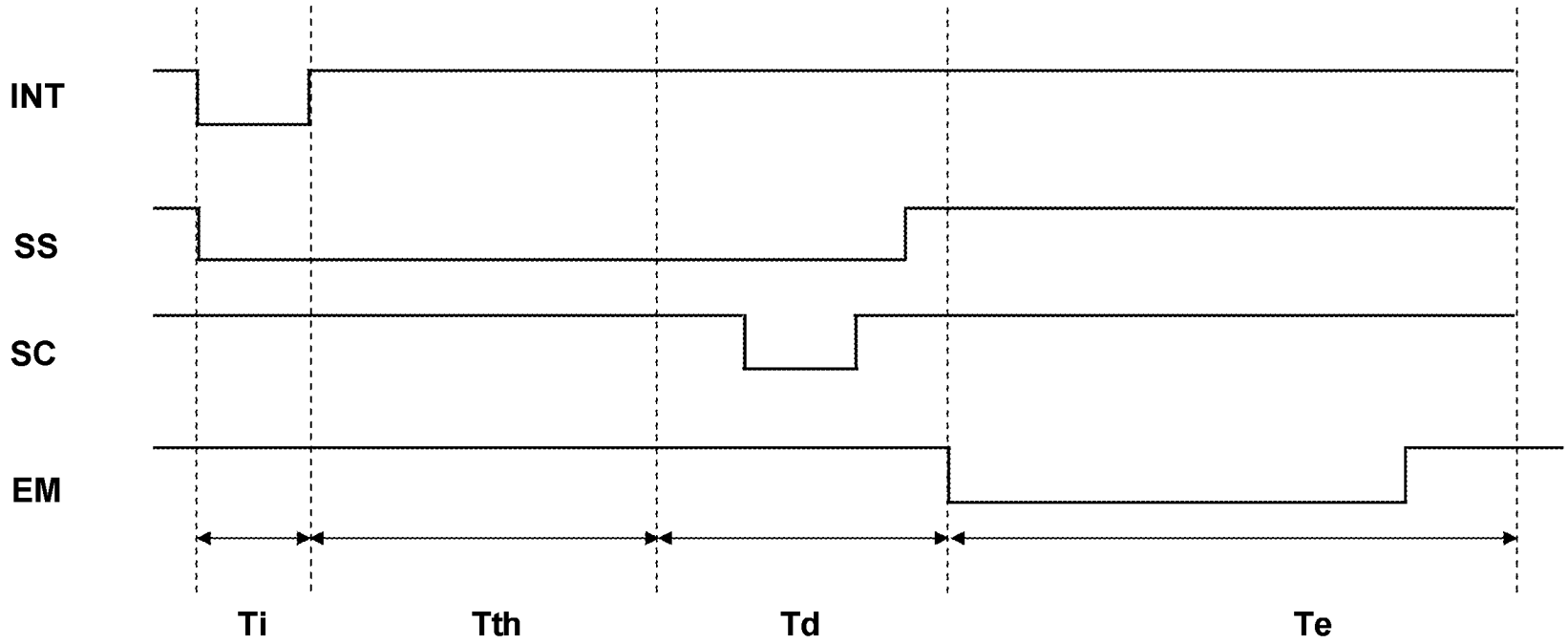
FIG. 13 is an example timing chart of a scan signal, an initialization signal, a light emission control signal and a sense signal supplied to the pixels of FIG. 12.

FIG. 13 is an example timing chart of a scan signal SC, an initialization signal INT, a light emission control signal EM and a sense signal SS supplied to a pixel, such as the pixel illustrated in FIG. 12.

As shown in FIG. 13, the initialization signal INT, the sense signal SS, the scan signal SC and the light emission control signal EM are changed to an active state or an inactive state based on an initialization period Ti, a threshold voltage detection period Tth, a data writing period Td and a light emission period Te, all of which are sequentially generated. The active state of any signal of FIG. 13 means a low voltage level. The timing chart of FIG. 13 is equal to that of FIG. 8 except that the active state is set to a low voltage. As another embodiment, the light emission control signal EM may be continuously maintained in the active state during the light emission period Te of FIG. 13.

The first capacitor Cgds of each embodiment may receive any one of the reference voltage Vref, the initialization voltage Vinit and the second driving voltage VSS instead of the first driving voltage VDD. That is, any one of the reference voltage Vref, the initialization voltage Vinit and the second driving voltage VSS may be supplied to one side of the first capacitor Cgds instead of the first driving voltage VDD.

In each embodiment, a dual capacitor may be further formed between the first capacitor Cgds and the sensing switching element Tr_SS. At this time, the dual capacitor includes a first electrode made of indium tin oxide (ITO), a second electrode formed of the same material as a gate electrode (a gate electrode of each switching element) and a third electrode located between the first electrode and the second electrode and formed of the same material as a source/drain electrode (a source/drain electrode of each switching element). At this time, any one of the first driving voltage VDD, the reference voltage Vref, the initialization voltage Vinit and the second driving voltage VSS may be applied to the first electrode and, similarly, any one of the first driving voltage VDD, the reference voltage Vref, the initialization voltage Vinit and the second driving voltage VSS may be applied to the second electrode. For example, the initialization voltage Vinit may be applied to the first electrode and the reference voltage Vref may be applied to the second electrode.

Figure 14:
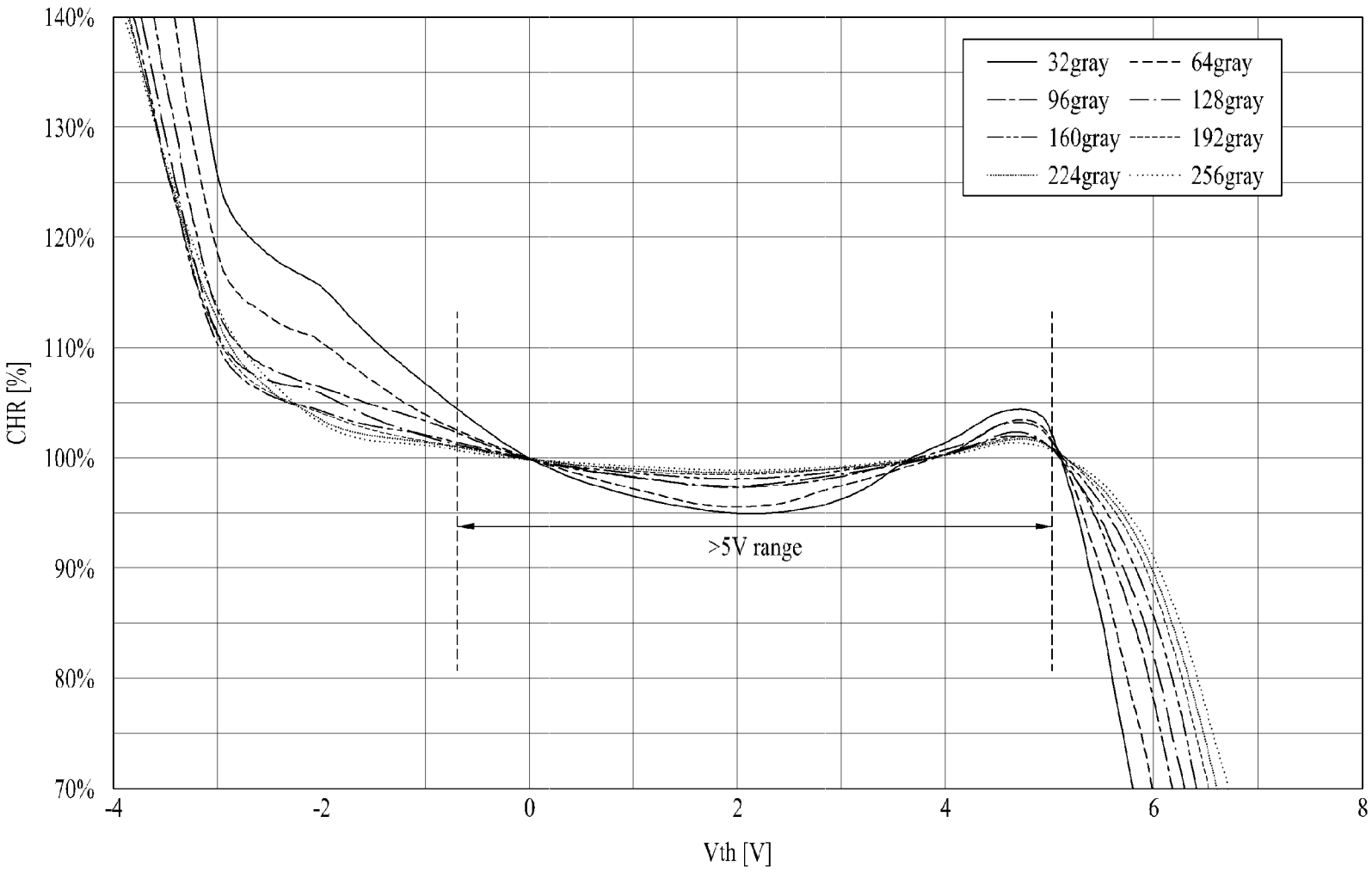
FIG. 14 is a diagram illustrating threshold voltage compensation capabilities per gray scale according to change in threshold voltage of a driving switching element included in the pixel of FIG. 2.

FIG. 14 is a diagram illustrating threshold voltage compensation capabilities at each gray scale according to change in threshold voltage of the driving switching element Tr_DR included in the pixel of FIG. 2.

In FIG. 14, an X axis denotes the threshold voltage Vth of the driving switching element Tr_DR and a Y axis denotes a current change ratio of a normalized light emitting diode OLED.

As shown in FIG. 14, if the current change ratio of the light emitting diode OLED is 95% to 105% (5%), the current change ratio is substantially constant at each gray scale even when the threshold voltage of the driving switching element Tr_DR is shifted within a wide range (a range of 6 [V]) of −0.8 [V] to 5.2 [V].

Figure 15:
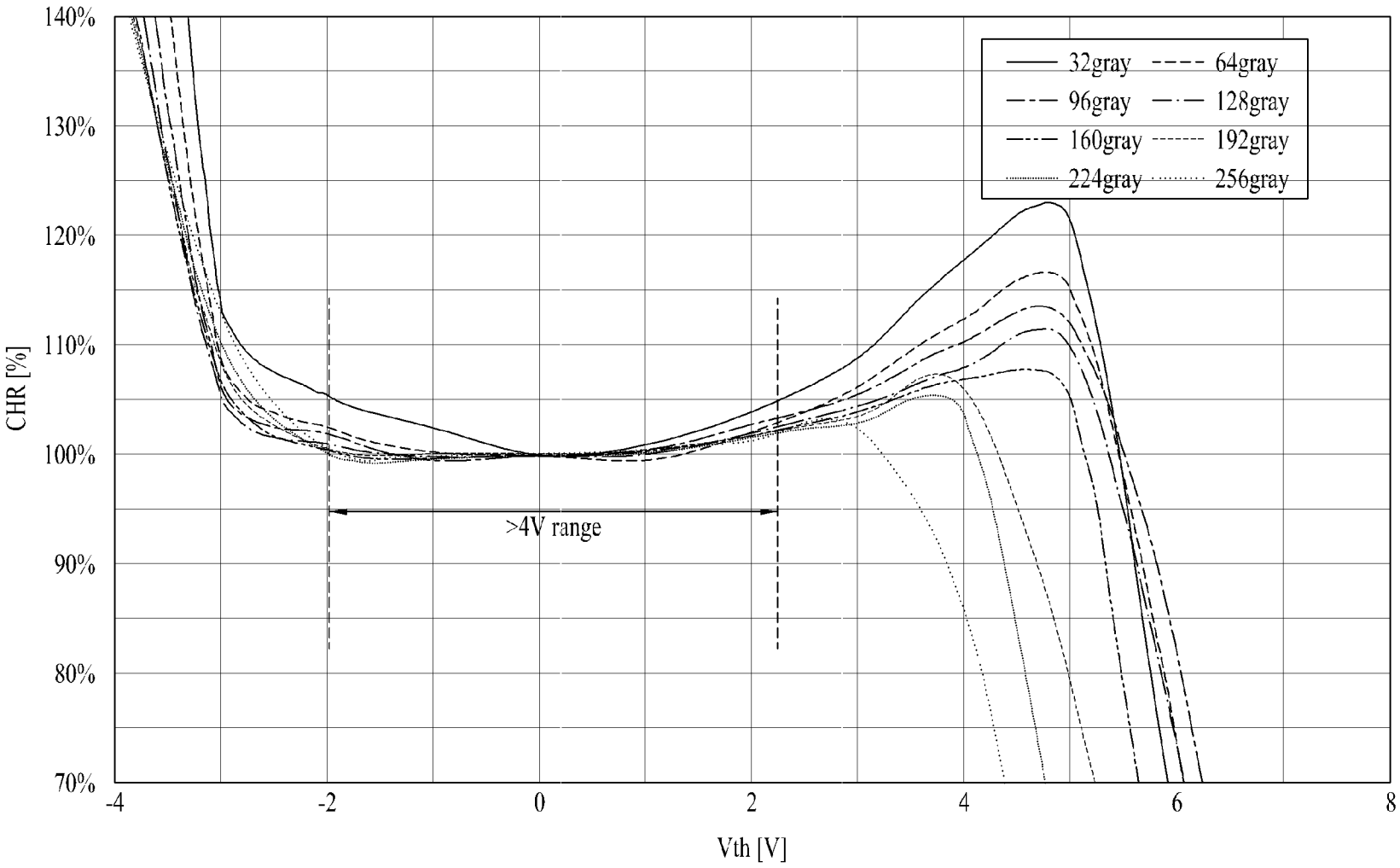
FIG. 15 is a diagram illustrating threshold voltage compensation capabilities per gray scale according to change in threshold voltage of all switching elements included in the pixel of FIG. 2.

FIG. 15 is a diagram illustrating threshold voltage compensation capabilities at each gray scale according to change in threshold voltage of all switching elements included in the pixel of FIG. 2.

In FIG. 15, an X axis denotes the threshold voltage Vth of each switching element and a Y axis denotes a current change ratio of a normalized light emitting diode OLED.

As shown in FIG. 15, if the current change ratio of the light emitting diode OLED is 95% to 105% (5%), the current change ratio is substantially constant at each gray scale even when the threshold voltage of the driving switching element Tr_DR is shifted within a wide range (a range of 4.2 [V]) of −2 [V] to 2.2 [V].

Figure 16:
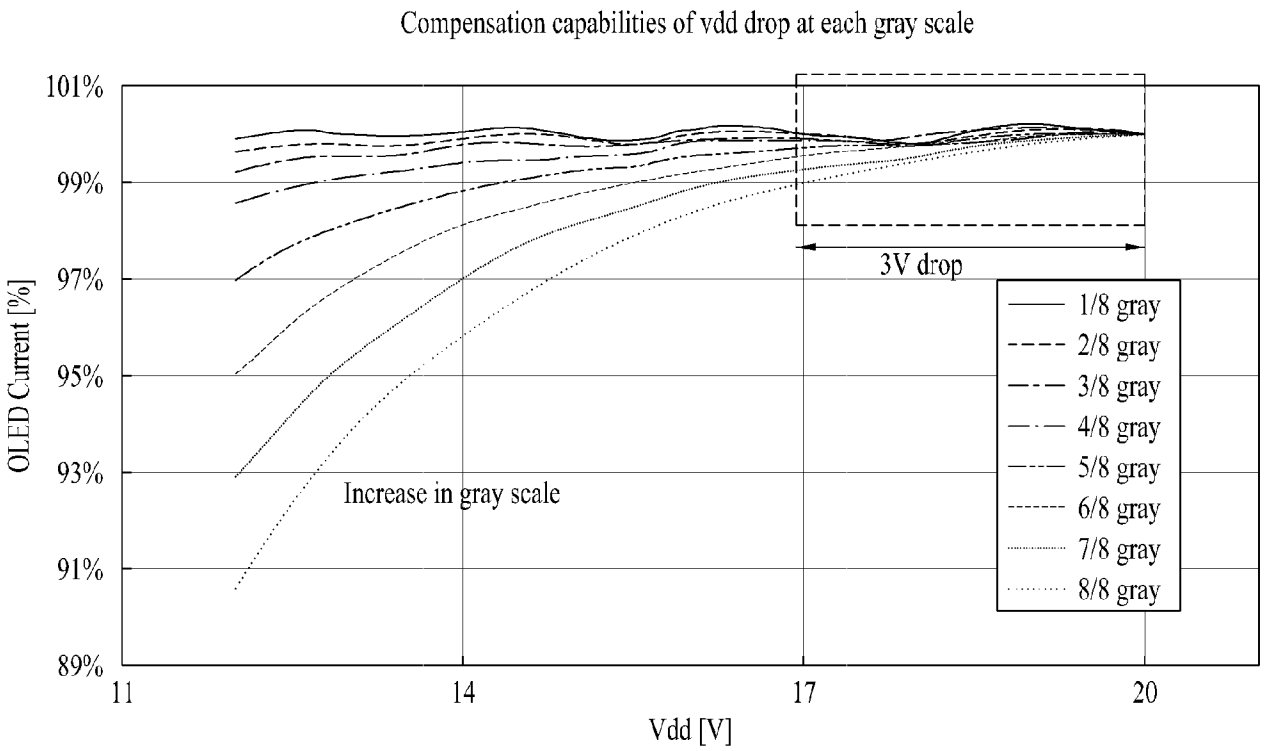
FIG. 16 is a diagram showing current change (compensation capabilities) according to voltage drop (IR drop) of a first driving voltage in a display unit including the pixel of FIG. 2.

FIG. 16 is a diagram showing current change (compensation capabilities) according to voltage drop (IR drop) of a first driving voltage VDD in a display unit including the pixel of FIG. 2.

In FIG. 16, an X axis denotes a first driving voltage VDD and a Y axis denotes a current change ratio of a normalized light emitting diode OLED.

As shown in FIG. 16, when voltage drop (IR drop) of the first driving voltage VDD is 3 [V] with respect to gray scale 64 (gray scale 2/8), the current of the light emitting diode OLED (OLED current) is returned to a high level of 99.9% as compared to the initial current.

Figure 17:
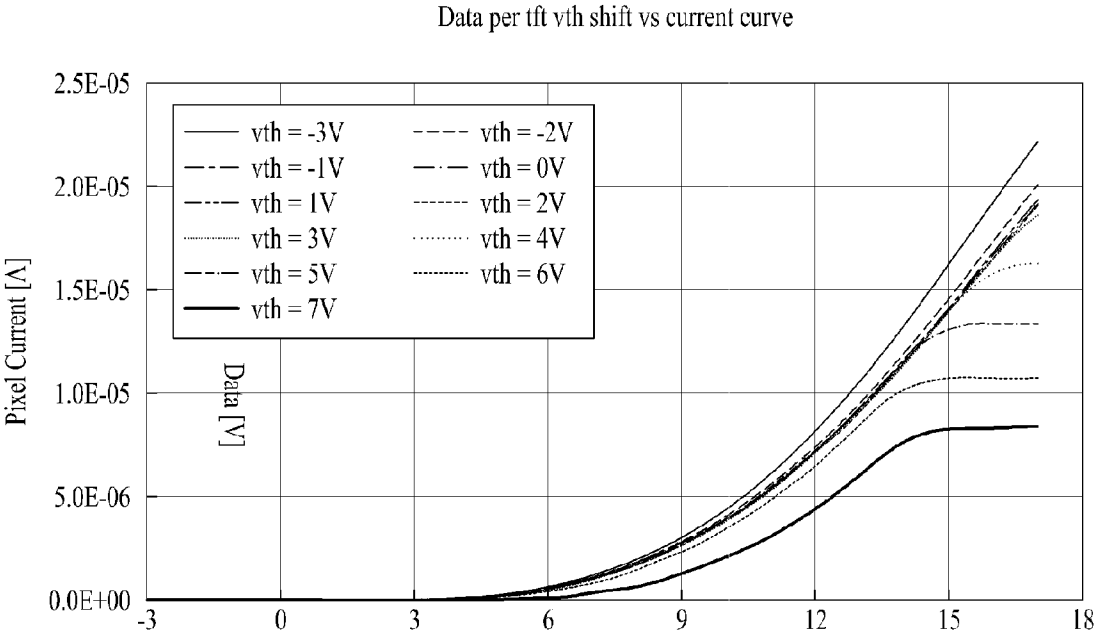
FIG. 17 is a diagram showing current change of a light emitting diode according to change in data signal applied to pixels of FIG. 2 and change in threshold voltages of the driving switching element.

FIG. 17 is a diagram showing current change of a light emitting diode according to change in a data signal applied to the pixel of FIG. 2 and change in threshold voltages of the driving switching element.

As can be seen from FIG. 17, a contrast ratio is greater than 100,000. In addition, the pixel of the present invention has high current capabilities. The pixel of the present invention has the same gamma properties within a data signal value in a range of −1 [V] to 5 [V], which is a threshold voltage compensation region.

Each of the switching elements shown in FIGS. 2, 7, 10 and 12 may be composed of any one of an n type transistor and a p type transistor.

For example, the data switching element Tr_DS, the light emission control switching element TR_EC, the driving switching element Tr_DR, the sensing switching element Tr_SS, the initialization switching element Tr_IT and the reference switching element Tr_RE of FIG. 2 may all be composed of p type transistors instead of n type transistors.

In addition, the light emission control switching element TR_EC, the driving switching element Tr_DR, the sensing switching element Tr_SS, the initialization switching element Tr_IT and the first reference switching element Tr_RE1 and the second reference witching element Tr_RE2 of FIG. 12 may all be composed of n type transistor instead of p type transistors.

In the first to fourth embodiments, the light emission control switching element Tr_EC and the second capacitor Cem may be removed from the pixel. In this case, the first node N1 and the second node N2 may be directly coupled to each other.

In the first to fourth embodiments, the threshold voltage Vth may be detected using the data signal. For example, during the initialization period Ti, the data signal Vdata from the data line DL may be supplied to the first node N1 and the second node N2 instead of the reference voltage Vref. By setting the scan signal SC to the active state during the initialization period Ti and turning the data switching element Tr_DS on during this period, the first node N1 and the second node N2 may be initialized to the data signal Vdata by the data signal Vdata from the data line DL. At this time, the reference voltage Vref may be applied before the light emission period Te.

The light emitting display device according to the present invention has the following effects.

First, since the number of parasitic capacitors of the switching elements of the first to third nodes is small, the quantity of charges lost by the parasitic capacitors is small. Accordingly, the compensation period of the threshold voltage is improved, the compensation ratio of the threshold voltage is high, and the compensation range of the threshold voltage is large.

Second, since current generated by the first driving voltage in the initialization period is sunk from the driving switching element to the initialization voltage source, excellent threshold voltage compensation capabilities are obtained even when the threshold voltage of the driving switching element is less than or greater than 0.

Third, since the sensing switching element is located at a next stage of the light emission control switching element in the light emission period, there is a compensation pixel of a normally off state. Accordingly, it is possible to improve reliability of the data switching element.

Fourth, since the first and second nodes or the first to third nodes are simultaneously initialized to a constant voltage in the initialization period, it is possible to remove an initialization timing problem between nodes. Accordingly, mass production of the light emitting display device is possible Fifth, since a constant voltage, that is, a reference voltage, is supplied to the second node during the data writing period in which the data signal is applied to the first node, it is possible to eliminate influence of a gray scale on the data signal. Thus, it is possible to reduce a difference between the threshold voltages of the driving switching elements of the pixels.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A light emitting display device comprising a plurality of pixels for displaying an image, wherein each pixel includes:

a data switching element controlled according to a scan signal from a scan line and coupled between a data line and a first node;

a light emission control switching element controlled according to a light emission control signal from a light emission control line and coupled between the first node and a second node;

a driving switching element controlled according to the voltage of the second node and coupled between a first driving power supply line for transmitting a first driving voltage and a third node;

a sensing switching element controlled according to a sense signal from a sense line and coupled between a first capacitor and the second node;

an initialization switching element controlled according to an initialization signal from an initialization line and coupled between the third node and an initialization power supply line for transmitting an initialization voltage;

a reference switching element controlled according to the initialization signal from the initialization line and coupled between the second node and a reference power supply line for transmitting a reference voltage;

a second capacitor coupled between the first node and the second node;

a third capacitor coupled between the first node and the third node; and a light emitting diode having an anode electrode coupled to the third node and a cathode electrode coupled to a second driving power supply line for transmitting a second driving voltage, wherein the first capacitor is coupled between the sensing switching element and the first driving power supply line, wherein the scan signal, the initialization signal, the light emission control signal and the sense signal are changed to an active state or an inactive state based on an initialization period, a threshold voltage detection period, a data writing period and a light emission period, all of which are sequentially generated, wherein, during the initialization period, the initialization signal, the sense signal and the light emission control signal are maintained in the active state and the scan signal is maintained in the inactive state, wherein, during the threshold voltage detection period, the sense signal is maintained in the active state and the initialization signal, the scan signal and the light emission control signal are maintained in the inactive state, wherein, during the data writing period, the scan signal and the sense signal are maintained in the active state and the initialization signal and the light emission control signal are maintained in the inactive state, wherein, during the data writing period, a data signal is supplied to the data line, and wherein, during the light emission period, the light emission control signal is sequentially in the active state and the inactive state or is maintained in the active state and the scan signal, the initialization signal and the sense signal are maintained in the inactive state.

2. The light emitting display device according to claim 1, wherein:

the pulse width of the scan signal in the active state is equal to the pulse width of the initialization signal in the active state, a p-th (p being a natural number) pixel and a (p+x)-th (x being a natural number) pixel are located at different pixel rows, the phases of a scan signal supplied to the p-th pixel and a scan signal supplied to the (p+x)-th pixel are different from each other, the phases of the scan signal supplied to the p-th pixel and an initialization signal supplied to the (p+x)-th pixel are identical, and a scan line coupled to a data switching element of the p-th pixel and a light emission control line coupled to a light emission control switching element of the (p+x)-th pixel are coupled to each other.

3. A light emitting display device comprising a plurality of pixels for displaying an image, wherein each pixel includes:

a data switching element controlled according to a scan signal from a scan line and coupled between a data line and a first node;

a light emission control switching element controlled according to a light emission control signal from a light emission control line and coupled between the first node and a second node;

a driving switching element controlled according to the voltage of the second node and coupled between a first driving power supply line for transmitting a first driving voltage and a third node;

a sensing switching element controlled according to a sense signal from a sense line and coupled between a first capacitor and the second node;

an initialization switching element controlled according to an initialization signal from an initialization line and coupled between the third node and an initialization power supply line for transmitting an initialization voltage;

a first reference switching element controlled according to the initialization signal from the initialization line and coupled between the first node and a reference power supply line for transmitting a reference voltage;

a second reference switching element controlled according to the initialization signal from the initialization line and coupled between the second node and the reference power supply line;

a second capacitor coupled between the first node and the second node;

a third capacitor coupled between the first node and the third node; and a light emitting diode having an anode electrode coupled to the third node and a cathode electrode coupled to a second driving power supply line for transmitting a second driving voltage, wherein the first capacitor is coupled between the sensing switching element and the first driving power supply line, wherein the scan signal, the initialization signal, the light emission control signal and the sense signal are changed to an active state or an inactive state based on an initialization period, a threshold voltage detection period, a data writing period and a light emission period, all of which are sequentially generated, wherein, during the initialization period, the initialization signal and the sense signal are maintained in the active state and the scan signal and the light emission control signal are maintained in the inactive state, wherein, during the threshold voltage detection period, the sense signal is maintained in the active state and the initialization signal, the scan signal and the light emission control signal are maintained in the inactive state, wherein, during the data writing period, the scan signal and the sense signal are maintained in the active state and the initialization signal and the light emission control signal are maintained in the inactive state, wherein, during the data writing period, a data signal is supplied to the data line, and wherein, during the light emission period, the light emission control signal is sequentially in the active state and the inactive state or is maintained in the active state and the scan signal, the initialization signal and the sense signal are maintained in the inactive state.

4. A light emitting display device comprising a plurality of pixels for displaying an image, wherein each pixel includes:

a data switching element controlled according to a scan signal from a scan line and coupled between a data line and a first node;

a light emission control switching element controlled according to a light emission control signal from a light emission control line and coupled between the first node and a second node;

a driving switching element controlled according to the voltage of the second node and coupled between a cathode electrode of a light emitting element and a third node;

a sensing switching element controlled according to a sense signal from a sense line and coupled between a first capacitor and the second node;

an initialization switching element controlled according to an initialization signal from an initialization line and coupled between the third node and an initialization power supply line for transmitting an initialization voltage;

a reference switching element controlled according to the initialization signal from the initialization line and coupled between the second node and a reference power supply line for transmitting a reference voltage;

a second capacitor coupled between the first node and the second node;

a third capacitor coupled between the first node and the third node; and a light emitting diode having an anode electrode coupled to the third node and a cathode electrode coupled to a second driving power supply line for transmitting a second driving voltage, wherein the anode electrode of the light emitting diode is coupled to the first driving power supply line, wherein the first capacitor is coupled between the sensing switching element and the first driving power supply line, wherein the scan signal, the initialization signal, the light emission control signal and the sense signal are changed to an active state or an inactive state based on an initialization period, a threshold voltage detection period, a data writing period and a light emission period, all of which are sequentially generated, wherein, during the initialization period, the initialization signal, the sense signal and the light emission control signal are maintained in the active state and the scan signal is maintained in the inactive state, wherein, during the threshold voltage detection period, the sense signal is maintained in the active state and the initialization signal, the scan signal and the light emission control signal are maintained in the inactive state, wherein, during the data writing period, the scan signal and the sense signal are maintained in the active state and the initialization signal and the light emission control signal are maintained in the inactive state, wherein, during the data writing period, a data signal is supplied to the data line, and wherein, during the light emission period, the light emission control signal is sequentially in the active state and the inactive state or is maintained in the active state and the scan signal, the initialization signal and the sense signal are maintained in the inactive state.

5. A light emitting display device comprising a plurality of pixels for displaying an image, wherein each pixel includes:

a data switching element controlled according to a scan signal from a scan line and coupled between a data line and a first node;

a light emission control switching element controlled according to a light emission control signal from a light emission control line and coupled between the first node and a second node;

a driving switching element controlled according to the voltage of the second node and coupled between a cathode electrode of a light emitting diode and a third node;

a sensing switching element controlled according to a sense signal from a sense line and coupled between a first capacitor and the second node;

an initialization switching element controlled according to an initialization signal from an initialization line and coupled between the third node and an initialization power supply line for transmitting an initialization voltage;

a first reference switching element controlled according to the initialization signal from the initialization line and coupled between the first node and a reference power supply line for transmitting a reference voltage;

a second reference switching element controlled according to the initialization signal from the initialization line and coupled between the second node and the reference power supply line;

a second capacitor coupled between the first node and the second node;

a third capacitor coupled between the first node and the third node; and wherein an anode electrode of the light emitting diode is coupled to a first driving power supply line for transmitting a first driving voltage, wherein the first capacitor is coupled between the sensing switching element and the first driving power supply line, wherein the scan signal, the initialization signal, the light emission control signal and the sense signal are changed to an active state or an inactive state based on an initialization period, a threshold voltage detection period, a data writing period and a light emission period, all of which are sequentially generated, wherein, during the initialization period, the initialization signal and the sense signal are maintained in the active state and the scan signal and the light emission control signal are maintained in the inactive state, wherein, during the threshold voltage detection period, the sense signal is maintained in the active state and the initialization signal, the scan signal and the light emission control signal are maintained in the inactive state, wherein, during the data writing period, the scan signal and the sense signal are maintained in the active state and the initialization signal and the light emission control signal are maintained in the inactive state, wherein, during the data writing period, a data signal is supplied to the data line, and wherein, during the light emission period, the light emission control signal is sequentially in the active state and the inactive state or is maintained in the active state and the scan signal, the initialization signal and the sense signal are maintained in the inactive state.

6. The light emitting display device according to claim 1, wherein the first capacitor is a parasitic capacitor between a gate electrode and a drain electrode of the driving switching element.

7. The light emitting display device according to claim 1, wherein the initialization voltage is less than the reference voltage, the reference voltage is less than the second driving voltage, and the second driving voltage is less than the first driving voltage.

8. The light emitting display device according to claim 1 wherein the data switching element, the light emission switching element, the driving switching element, the sensing switching element, the initialization switching element and the reference switching element are all n type transistors or p type transistors.

9. The light emitting display device according to claim 3, wherein the data switching element, the light emission switching element, the driving switching element, the sensing switching element, the initialization switching element, the first reference switching element and the second reference switching element are all n type transistors or p type transistors.

10. A light emitting display device comprising a plurality of pixels, each pixel including:

a light emitting element; and a current driving element configured to provide driving current through the light emitting element when turned on, the current driving element including a first terminal, a second terminal, and a third terminal, the first terminal configured to receive a data signal voltage, the current driving element being switched from an off state to an on state to provide the driving current when a first voltage difference between the first terminal and the second terminal exceeds a threshold voltage, and a magnitude of the driving current being dependent upon a second difference between the first voltage difference and the threshold voltage, wherein prior to the current driving element providing the driving current through the light emitting element, a voltage at the second terminal is set to be a sum of the threshold voltage and at least a predetermined constant value.

11. The light emitting display device of claim 10, wherein the current driving element of each of the pixels provides substantially same driving current through the light emitting element responsive to substantially same data signal voltage.

12. The light emitting display device of claim 10, wherein each pixel further comprises:

a first capacitor coupled between the first terminal and a first node;

a second capacitor coupled between the first node and the second terminal; and a sense element coupled between the first terminal and the third terminal of the current driving element, the sense element when turned on configured to establish a current path through the current driving element, the first capacitor, and the second capacitor to set the voltage at the second terminal of the current driving element to be the sum of the threshold voltage and at least the predetermined constant value.

13. The light emitting display device of claim 10, wherein the light emitting element is turned off while the voltage at the second terminal of the current driving element is set to be the sum of the threshold voltage and at least the predetermined constant value.

14. The light emitting display device of claim 12, wherein each pixel further comprises a light emission control element configured to couple the first node to the gate terminal of the driving element, and wherein the second capacitor receives the data signal voltage at the first node, subsequent to the voltage at the second terminal of the current driving element being set to the sum of the threshold voltage and at least the predetermined constant value, and wherein the light emission control element being turned on to couple the data signal voltage at the first node to the first terminal of the current driving element to turn on the light emitting element and provide the driving current through the light emitting element.

15. The light emitting display device of claim 14, wherein the sense element is indirectly coupled to the third terminal of the current driving element through a third capacitor, and wherein the sense element is maintained on while the second capacitor receives the data signal voltage at the first node to prevent the voltage at the second terminal or the third terminal of the current driving element from changing.

16. A method of operating a light emitting display device including a plurality of pixels, each pixel including at least a light emitting element and a current driving element configured to provide driving current through the light emitting element when turned on, the current driving element including a first terminal, a second terminal, and a third terminal, the first terminal configured to receive a data signal voltage, the current driving element being switched from an off state to an on state to provide the driving current when a first voltage difference between the first terminal and the second terminal exceeds a threshold voltage, and a magnitude of the driving current being dependent upon a second difference between the first voltage difference and the threshold voltage, the method comprising:

setting a voltage at the second terminal to be a sum of the threshold voltage and at least a predetermined constant value; and turning on the current driving element to provide the driving current through the light emitting element.

17. The method of claim 16, wherein the current driving element of each of the pixels provides substantially same driving current through the light emitting element responsive to substantially same data signal voltage.

18. The method of claim 16, wherein the light emitting element is turned off while the voltage at the second terminal of the current driving element is set to be the sum of the threshold voltage and at least the predetermined constant value.

* * * * *